US007114793B2

(12) United States Patent
Katsuta et al.

(10) Patent No.: US 7,114,793 B2
(45) Date of Patent: Oct. 3, 2006

(54) RECORDING APPARATUS

(75) Inventors: Nobuhiro Katsuta, Ebina (JP); Hiroaki Satoh, Ebina (JP); Yoshihira Rai, Ebina (JP); Akira Mihara, Ebina (JP); Kenichi Kawauchi, Ebina (JP); Naoki Morita, Ebina (JP); Hiroshi Ikeda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 198 days.

(21) Appl. No.: 10/778,036

(22) Filed: Feb. 17, 2004

(65) Prior Publication Data

US 2004/0227785 A1 Nov. 18, 2004

(30) Foreign Application Priority Data

Feb. 17, 2003 (JP) ..... 2003-037854
Aug. 19, 2003 (JP) ..... 2003-295649

(51) Int. Cl.
*B41J 2/165* (2006.01)

(52) U.S. Cl. ..... 347/22; 347/29; 347/32

(58) Field of Classification Search ..... 347/22, 347/23, 24, 29, 30, 31, 32, 33
See application file for complete search history.

(56) References Cited

U.S. PATENT DOCUMENTS 4,739,340 A * 4/1988 Terasawa ..... 347/30
5,040,000 A * 8/1991 Yokoi ..... 347/30
5,455,609 A * 10/1995 Gast et al. ..... 347/32
6,270,183 B1 * 8/2001 Gaarder ..... 347/29
2004/0179062 A1 * 9/2004 Rai et al. ..... 347/42

FOREIGN PATENT DOCUMENTS

JP A 2-179754 7/1990
JP A 3-92358 4/1991
JP 11-348313 * 12/1999
JP 2000-015835 * 1/2000

* cited by examiner

*Primary Examiner*—Huan Tran
(74) *Attorney, Agent, or Firm*—Oliff & Berridge, PLC

(57) ABSTRACT

A recording apparatus contains a recording head having a liquid droplet ejecting surface and ejecting a liquid droplet to a recording medium, a maintenance device disposed at a position opposite to the liquid droplet ejecting surface of the recording head, and a conveying unit which conveys the recording medium between the recording head and the maintenance device. The maintenance device has a liquid housing unit which houses the liquid droplet from the recording head, and a cleaning unit which cleans the liquid droplet ejecting surface of the recording head.

33 Claims, 33 Drawing Sheets

40
40A
80
87
88
90
92
Z
Y
X

RECORDING APPARATUS

BACKGROUND OF THE INVENTION

1. Field of the Invention

The present invention relates to a recording apparatus used as an output device of an ink-jet recording apparatus exerting recordation by ejecting an ink from a recording unit to a recording medium, or an apparatus having such a function, e.g., a facsimile, a duplicator, a printer multifunction machine and a workstation.

2. Description of the Related Art

In recent years, color documents have been widely spread in office use, and various kinds of output apparatuses have been proposed therefor. In particular, an ink-jet system, which can be miniaturized with low cost, is used in various kinds of output apparatuses.

A recording head used in the ink-jet system is constituted with an energy generating unit, an energy converting unit for converting energy generated by the energy generating unit to an ink ejecting force, an ink ejecting outlet for ejecting an ink droplet with the ink ejecting force, and an ink feeding path connected to the ink ejecting outlet for feeding an ink Examples of the energy generating unit include devices using an electromechanical converting element, such as a piezoelectric element, and devices, in which an ink is heated with an electrothermal conversion element having a resistive heater element to form a bubble, and the ink droplet is ejected with the formation of the bubble.

In the recording head utilizing an electrothermal conversion element, not only ink ejecting outlets can be arranged at a high density owing to the small size of the electrothermal conversion element, but also a production technique of a semiconductor integrated circuit can be transferred for the production technique therefor. Accordingly, a recording head having a large number of ink ejecting outlets with high accuracy can be miniaturized and can be produced at low cost.

However, what has been commonly used is a printing system referred to as a serial scanning system, in which a recording head is reciprocally moved with recording paper being conveyed to print by one line. While the system is of a small size and low cost, it has such a problem in that the printing speed is low due to necessity of plural frequencies of scanning of the recording head for forming an image over the paper. It is necessary to lower the scanning frequency in order to improve the printing speed, and extension of a recording head is essential therefor. At the outrance of the extension of a recording head, such a non-scanning printing system is proposed in that a recording head having the same width as recording paper is used. The printing system uses an ink-jet recording apparatus having a recording head having a width equivalent to recording paper, within which a large number of ejecting outlets are arranged over the length, which is substantially the same as the recording paper, and recordation is effected by moving the recoding paper with respect to the fixed recording head.

As described in the foregoing, in order to improve the printing speed to apply to office use, such an ink-jet recording apparatus is proposed that effects printing with a non-scanning recording head corresponding to the paper width on recording paper being continuously conveyed.

In order to maintain good ink ejection performance of an ink-jet recording apparatus, such operations are necessarily carried out with a maintenance device as ejection of an ink droplet in a non-printing state (dummy jet), cleaning of a nozzle surface (wiping), and prevention of an ink from being dried (capping).

For example, in the case where the non-printing state is continued for a prolonged period of time, the ink is dried to clog the nozzle, and dusts are attached to the nozzle surface. As a result, an ink droplet cannot be ejected (dot dropout), or the ejection direction of an ink droplet is changed to lower the printing quality or to disable printing.

Accordingly, in the case where printing is paused for a prescribed period, the recording head is moved from the printing position to a maintenance position within the ink-jet recording apparatus, and dusts attached to the nozzle surface of the recording head are wiped to refresh the nozzle surface.

In order to prevent the ejection performance of an ink droplet from being changed due to change in viscosity of the ink and formation of a bubble, an ink droplet is ejected from the recording head to a receiving member in a non-printing state.

In order to prevent the nozzle surface (nozzle) of the recording head from being dried, furthermore, a cap member is provided. The cap member presses a rubber part onto the nozzle surface to seal the nozzle surface (nozzle) from the exterior.

The ink-jet recording apparatus thus configured as described in the foregoing terminates printing operation after completing printing of a prescribed number of sheets and then effects maintenance operation. Therefore, the productivity is lowered in continuous printing.

In order to solve the problem, proposals have been made, in which a receiving member for receiving dummy jet is disposed at a position opposite to a nozzle surface of a recording head (as described, for example, in JP-A-11-348313 and JP-A-12-15835). In the ink-jet recording apparatus described in JP-A-11-348313 and JP-A-12-15835, a belt for conveying recording paper passes on the downside of the receiving member, whereby the receiving member is disposed at the position opposite to the recording head (nozzle surface). According to the configuration, dummy jet can be ejected onto the receiving member within a period between passage of preceding recording paper and arrival of subsequent recording paper, whereby the productivity is improved.

It has been also proposed that a hole for dummy jet is provided in a belt for conveying to enable ejection of dummy jet during continuous printing, whereby the productivity is improved (as described in JP-A-13-113690).

However, in the techniques described in JP-A-11-348313 and JP-A-12-15835, the recording head is moved from the printing position to the maintenance position upon carrying out the maintenance operation other than dummy jet. In the case where the apparatus is configured to move the recording head between the maintenance position and the printing position, such a problem occurs in that misalignment of the recording head occurs at the, printing position due to the movement to fluctuate the printing quality. Furthermore, another problem occurs in that the constitution of the apparatus is complicated due to the movement of the recording head within the apparatus.

In the case where recording paper is conveyed with a belt having a hole as described in JP-A-13-113690, on the other hand, printed matters can be output without problem in operation for a short period, but there are cases where stress is concentrated to the edge of the hole on the belt in operation for a prolonged period to impair stable running of the belt, whereby printing quality is deteriorated.

SUMMARY OF THE INVENTION

The recording apparatus of the invention contains a recording head for ejecting a liquid droplet to a recording medium, a maintenance device disposed at a position opposite to a liquid droplet ejecting surface of the recording head, and a conveying unit for conveying the recording medium between the recording head and the maintenance device, the maintenance device containing a liquid housing unit for housing the liquid droplet thus ejected from the recording head, and a cleaning unit for cleaning the liquid droplet ejecting surface of the recording head.

BRIEF DESCRIPTION OF DRAWINGS

Preferred embodiments of the present invention will be described in detail based on the following figures, wherein.

DESCRIPTION OF THE PREFERRED EMBODIMENTS

A recording apparatus according to an embodiment of the invention win be described.

Figure 1:
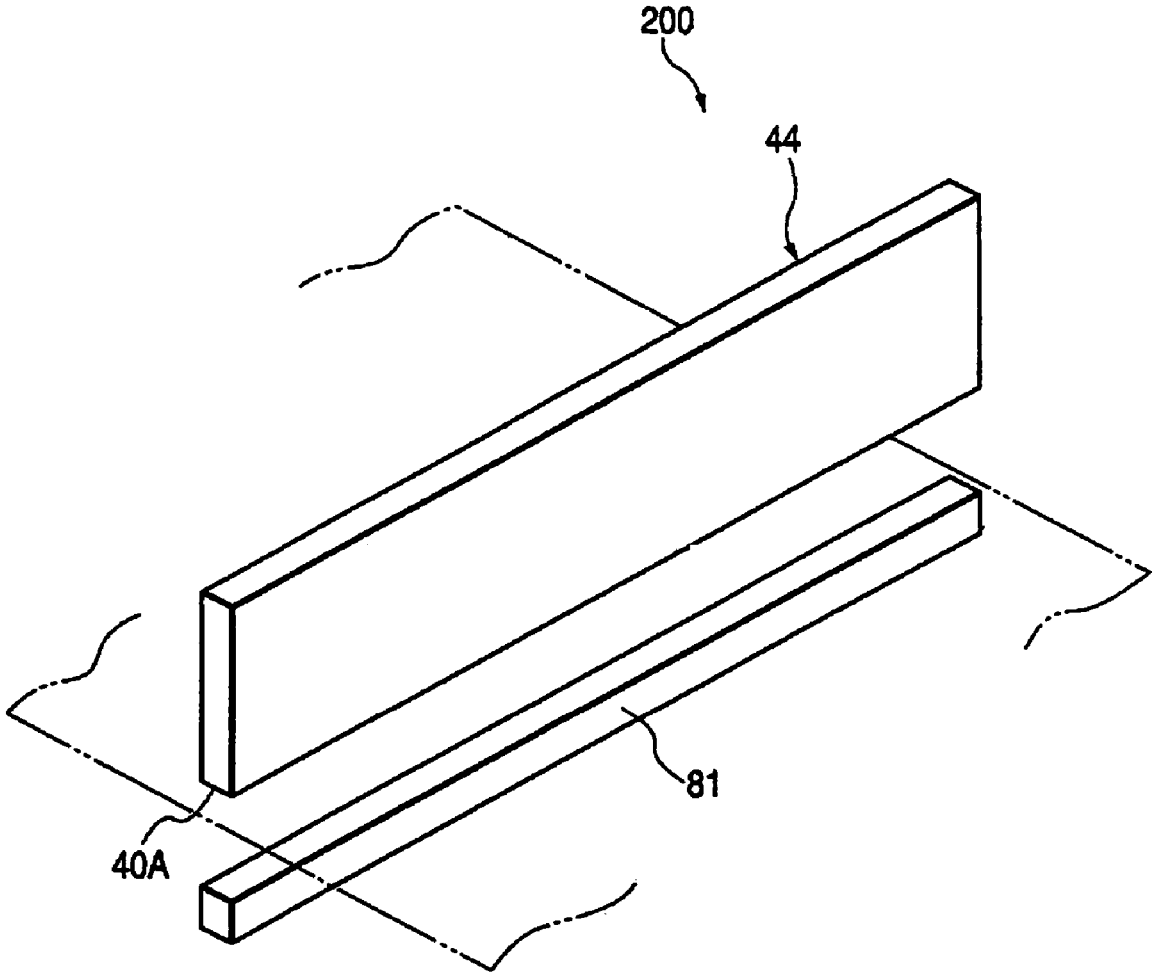
FIG. 1 is a schematic constitutional view showing a recording apparatus according to an embodiment of the invention.

As shown in FIG. 1, a recording apparatus 200 has a recording head 44 and a maintenance device 81 disposed as being opposite to the recording head 44.

The recording head 44 is not limited in species of an ink and the ejecting system for an ink droplet as far as it can eject an ink droplet from a nozzle surface 40A of the recording head 44. While the ejecting system of ink droplets of a unit recording head 40, which will be described later, is referred to be an ink-jet system, it is not limited thereto as far as it is a noncontact system capable of transferring a colorant directly to paper. Representative examples of the ejection system include an ink-jet system, but any known system may be applied thereto. The ink-jet system is not limited, and examples thereof include a thermal ink-jet system, a piezoelectric ink-jet system, a continuous flow ink-jet system and an electrostatic suction ink-jet system.

The ink used herein is not limited, and examples thereof include an aqueous ink an oily ink, a so called solid ink, which is in a solid state at ordinary temperatures, and a solvent ink. A colorant contained in the ink may be either a pigment or a dye.

Figure 2:
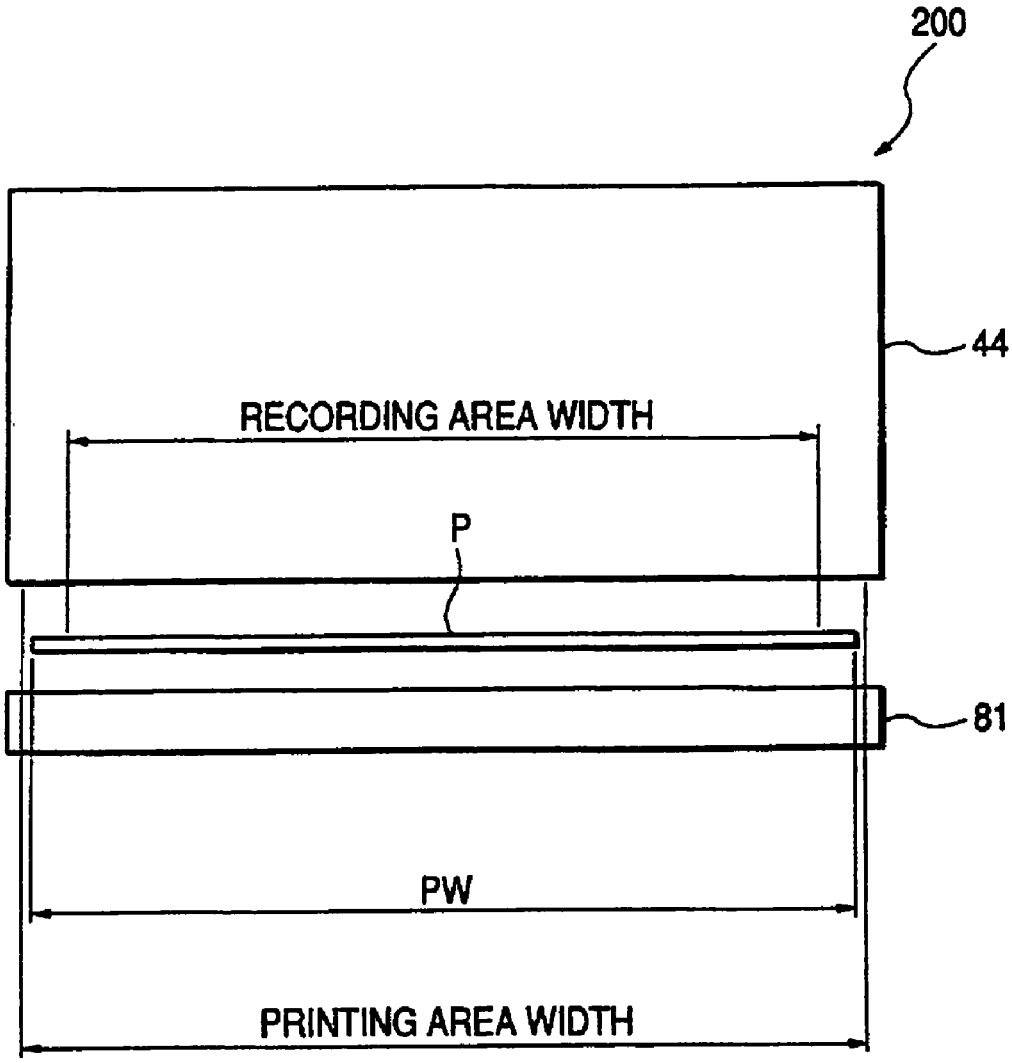
FIG. 2 is an explanatory view showing a printing area of a recording apparatus according to an embodiment of the invention.

The printing area of the recording head 44 is set as corresponding to a maximum paper width PW of paper P to be printed, as shown in FIG. 2. The printing area referred herein basically means the maximum width of the recording area, which is the full width of the paper except for margins on both sides, on which no printing is effected, but is generally larger than the maximum paper width PW, on which printing is effected. This is because there is such a possibility that paper is conveyed as being skewed at a certain angle with respect to the conveying direction, and there is an increasing demand of rimless printing.

The recording head 44 may be constituted with a long monolithic recording head chip or with plural short recording head chips (hereinafter refereed to as unit recording heads).

In the case where the recording head is constituted with plural unit recording heads, the following embodiment can be exemplified.

Figure 3:
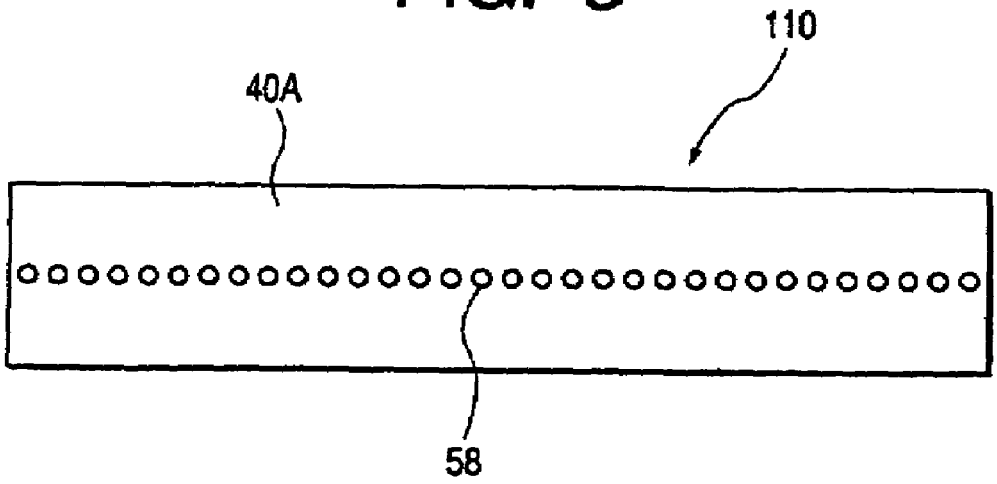
FIG. 3 is an explanatory view showing an example of a unit recording head according to an embodiment of the invention.
Figure 4:
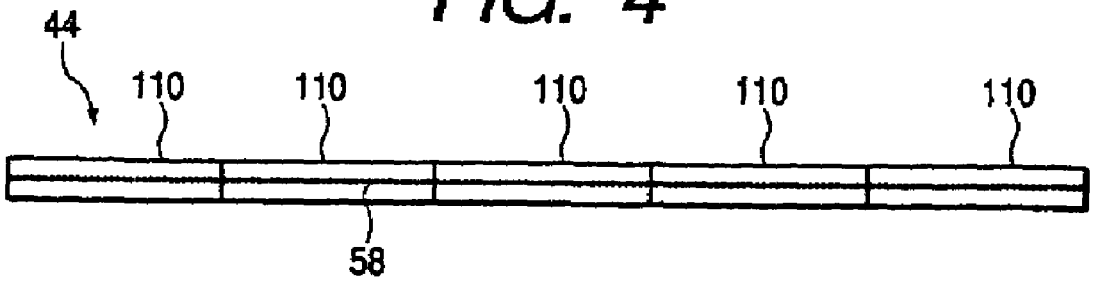
FIG. 4 is an explanatory view showing an example of a recording head according to an embodiment of the invention.
Figure 5:
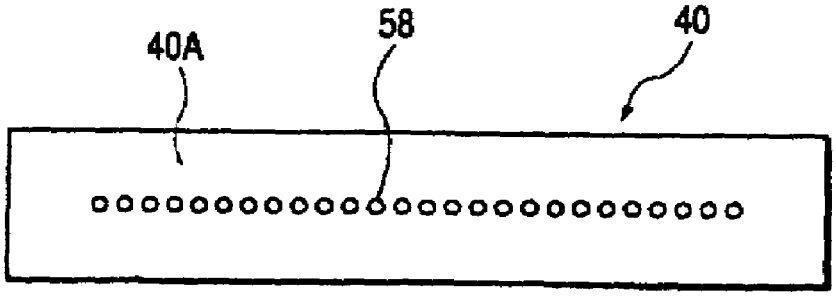
FIG. 5 is an explanatory view showing another example of a unit recording head according to an embodiment of the invention.
Figure 6:
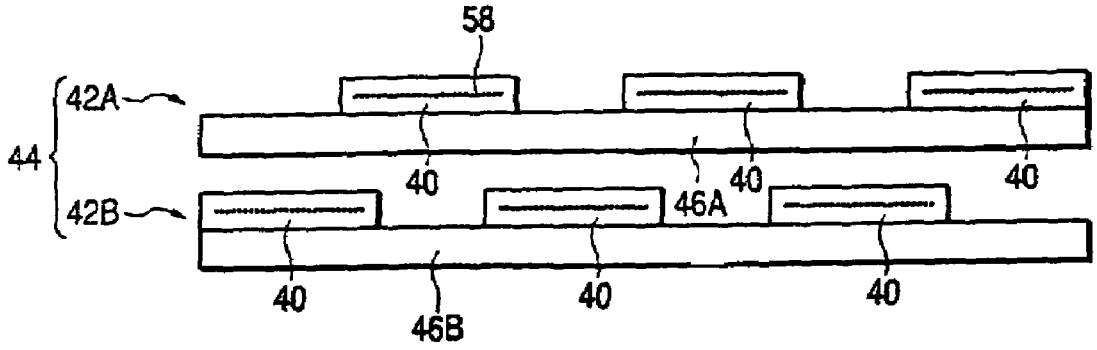
FIG. 6 is an explanatory view showing another example of a recording head according to an embodiment of the invention.
Figure 7:
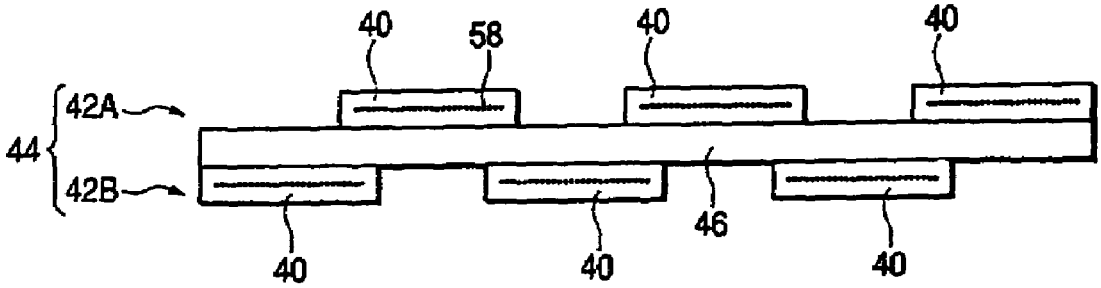
FIG. 7 is an explanatory view showing still another example of a recording head according to an embodiment of the invention.

For example, in the case where a unit recording head 110 has nozzles 58 formed to both ends of the nozzle arranging direction as shown in FIG. 3, the unit recording heads 110 are continuously arranged in the nozzle arranging direction to constitute compactly a recording head 44 shown in FIG. 4. In the case where a unit recording head 40 has nozzles 58 thereon except for both ends as shown in FIG. 5, a recording head 44 capable of printing over the paper width without gap can be constituted in such a manner that plural recording head arrays 42A and 42B, each of which has plural unit recording heads 40 arranged on a common substrate 46A or 46B at a constant interval in the nozzle arranging direction, are arranged in the conveying direction as shown in FIG. 6. In this case, further miniaturization can be attained by constituting the recording head arrays 42A and 42B on both surfaces of a single common substrate 46 as shown in FIG. 7.

Figure 8:
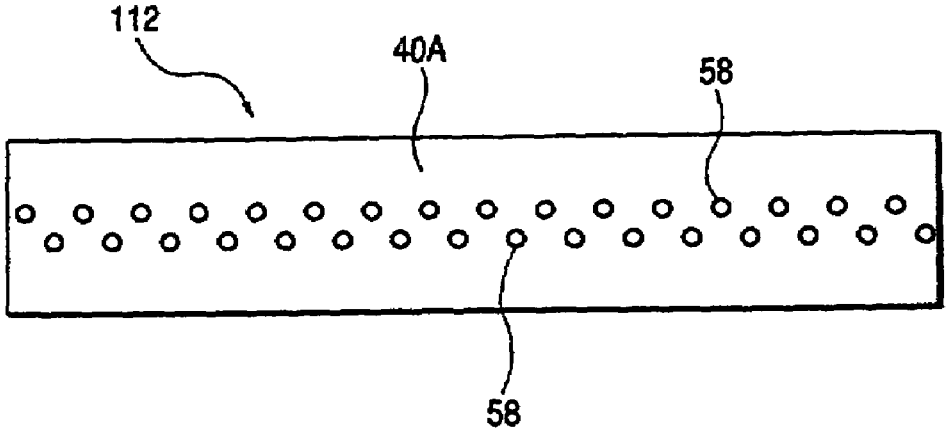
FIG. 8 is an explanatory view showing still another example of a unit recording head according to an embodiment of the invention.

While the arrangement of the nozzles in the unit recording heads 40 and 110 is of a straight form but is not limited thereto, and for example, nozzles may be arranged in a staggered form as shown in FIG. 8.

The recording apparatus 200 has four recording heads 44 in the conveying direction, from which ink droplets of yellow (Y), magenta (M), cyan (C) and black (K) are ejected therefrom, respectively, so as to attain full color printing.

Figure 9:
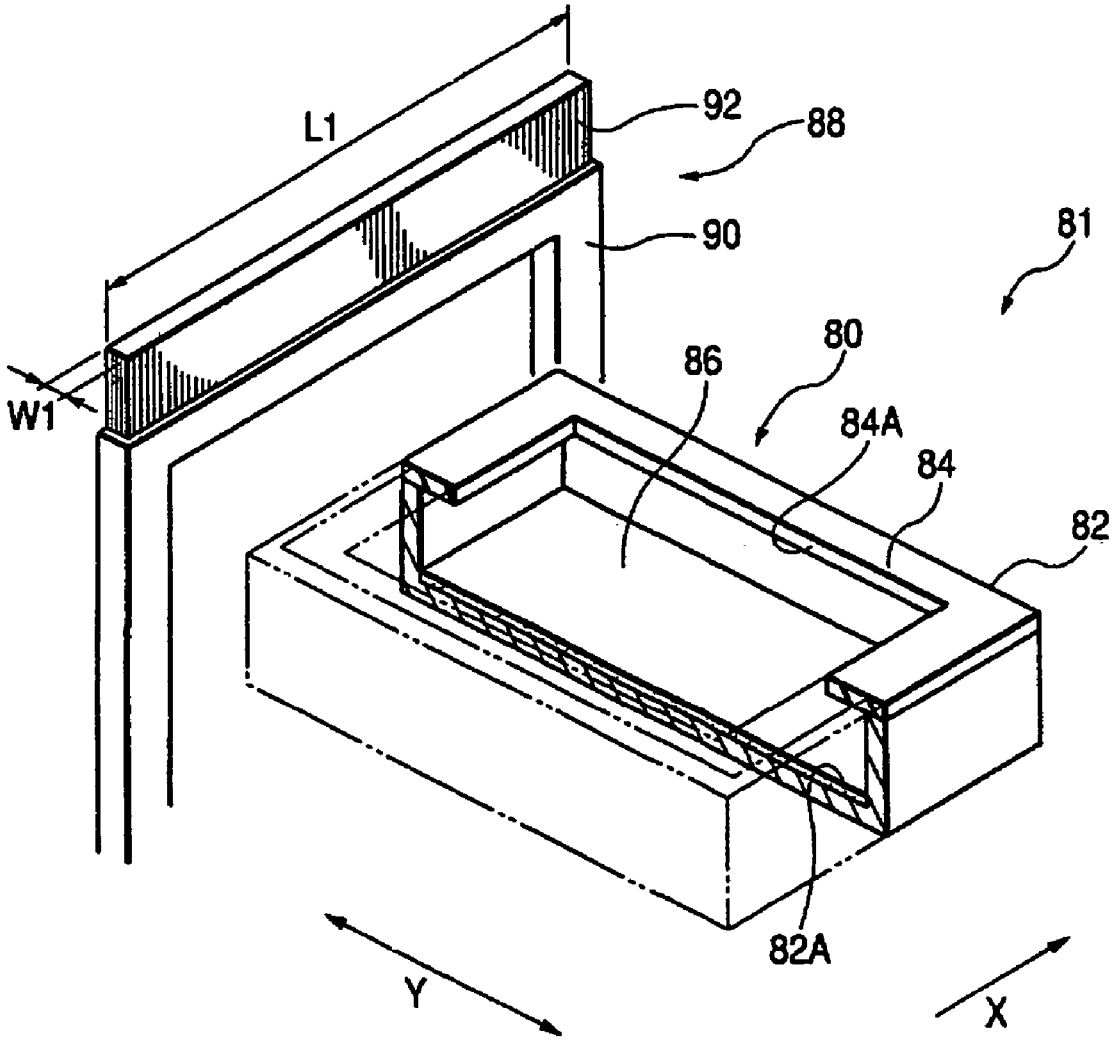
FIG. 9 is a perspective explanatory view showing a maintenance device according to an embodiment of the invention.

A maintenance device 81 disposed opposite to the recording head 44 has a cap unit (ink housing unit) 80 capable of housing an ink droplet and a cleaning unit 88 capable of cleaning a nozzle surface 40A of the recording head 44, as shown in FIG. 9.

The cap unit 80 has, as a minimal function, a function of housing a liquid droplet ejected from the recording head 44 upon dummy jet, which will be described later. In order therefor, as shown in FIG. 9, for example, it has a receiving member 82 having a concave part 82A formed corresponding to the nozzle surface 40A of the recording head 44, and an ink absorbent 86 for retaining an ink disposed at a bottom of the concave part 82A of the receiving member 82.

Figure 10C:
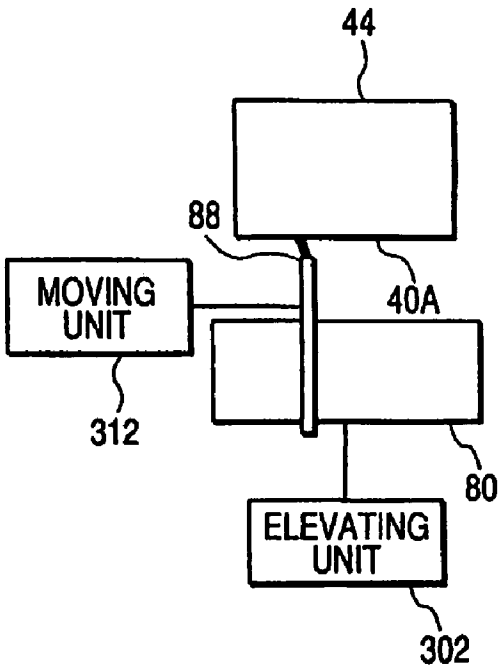
FIGS. 10A to 10C are operational explanatory views showing a maintenance device according to an embodiment of the invention.
Figure 10B:
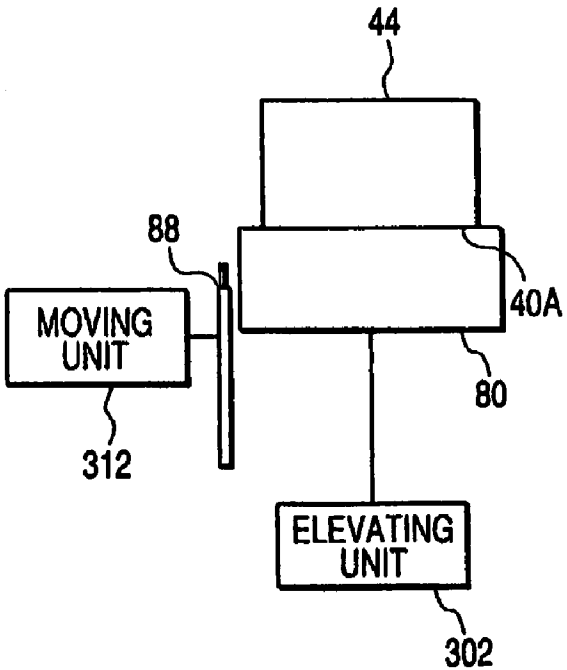
Figure 10A:
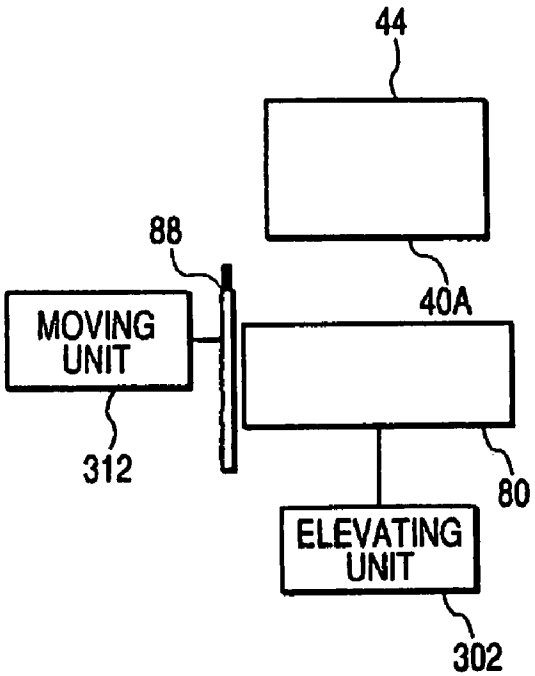

The cap unit 80 may also has other functions than the minimal function. For example, the cap unit 80 may be constituted as being capable of approaching to and leaving from the nozzle surface 40A of the recording head 44 (hereinafter referred to as elevating) with an elevating unit 302, and the cap unit 80 is pressed onto the nozzle surface 40A to seal the nozzle surface 40A (i.e., capping), as shown in FIGS. 10A to 10C. In this case, it is necessary to provide a rubber member 84 on an upper part (the nozzle surface side) of the receiving member 82 in order to seal the nozzle surface 40A of the recording head 44 upon pressing, as shown in FIG. 9. The cap unit 80 (rubber member 84) maybe constituted to cover the entire nozzle surface in order to prevent a recording liquid in the nozzles from being dried and to prevent attachment of dirt and dusts to the nozzle surface 40A.

The receiving member 82 may be constituted with a plastic material, and examples of the plastic material include POM, PET, PBT, PPS, nylon 66, acrylic resins and Bakelite, and PBT is preferred from the standpoint of mold ability, impact resistance and the like.

Examples of the rubber material constituting an elastic member used as the rubber member 84 include various kinds of natural rubber and elastomers, such as caoutchouc, isoprene rubber, butadiene rubber, olefin rubber, ether rubber, polysulfide rubber, urethane rubber, fluorinated rubber and silicone rubber as well as blended rubber of these rubber materials, and blended rubber of the rubber material and various kinds of plastics. These materials may be combined by adhesion or the like means.

Among these materials, hydrogenated nitrile butadiene rubber, ethylene propylene rubber (EPDM), polydimethylsilicone rubber, methylvinylsilicone rubber, methylphenylsilicone rubber and fluorosilicone rubber are preferred from the standpoint of weather resistance, chemical resistance, wear resistance and workability.

Examples of a material of the ink absorbent 86 include a polyester felt fibrous material and an acrylonitrile felt fibrous material, and a mixture of a polyester felt fibrous material and an acrylonitrile felt fibrous material can also be preferably used The ink holding capability of the ink absorbent 86 can be finely adjusted by appropriately changing the fiber diameter, the fiber length and the arranging direction of the fibrous material used.

Examples thereof also include a polyamide fibrous material, a polypropylene fibrous material, a polyvinyl alcohol fibrous material, a polyvinylidene chloride fibrous material and a polyurethane fibrous material.

A polyester fibrous material is preferably used from the standpoint of absorbance of a recording liquid such as an ink, and a mixed system of these materials may also be preferably used.

The cleaning unit 88 is to remove dirt, dusts and an ink on the nozzle surface 40A on the recording head 44 to maintain the constant ejecting capability of an ink droplet.

The cleaning unit 88 is constituted with a wiper 92, a retaining member 90 for retaking the wiper 92 as shown in FIG. 9, and a moving unit 312 (as shown in FIGS. 10A to 10C) for moving the cleaning unit 88 in the elevational direction and the widthwise direction.

Figure 17:
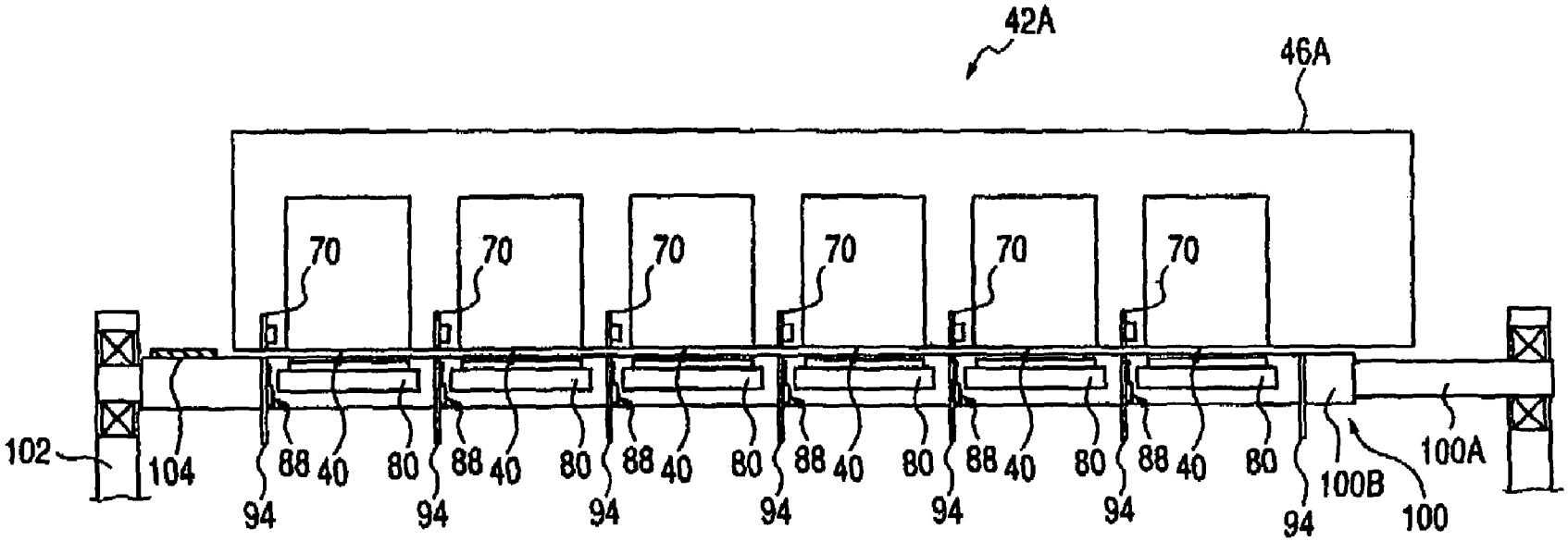
FIG. 17 is a vertical cross sectional view showing a recording part according to Example 1 of the invention.
Figure 32:
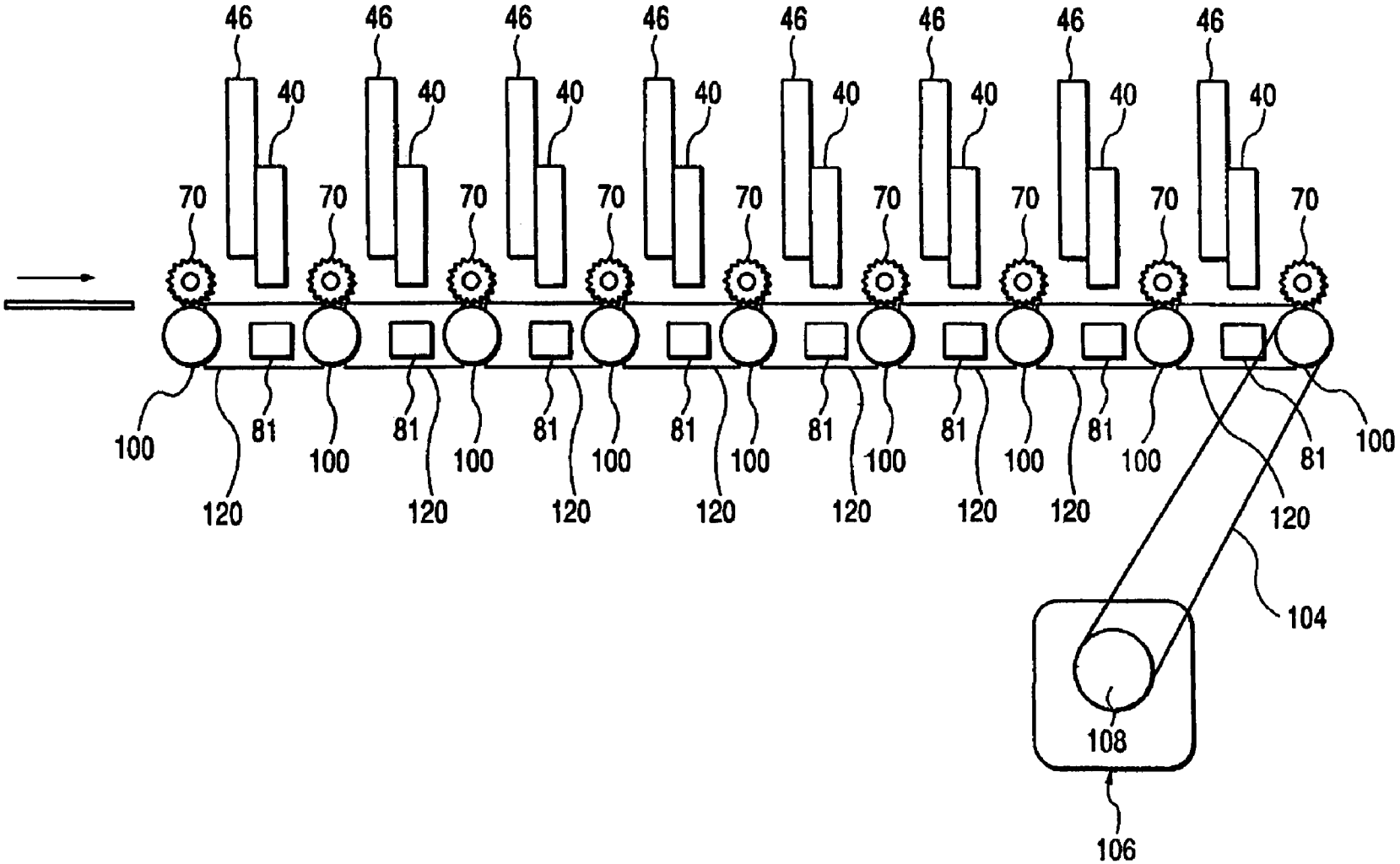
FIG. 32 is an explanatory view showing a driving mechanism of a recording apparatus according to Example 2 of the invention.

The wiping member 88 is constituted as shown in FIGS. 17 and 32, so that all the wiping members 88 corresponding to the unit recording heads 40 constituting the recording head array 42 are unitized by attaching them to the common substrate 310 and are integrally capable of approaching and leaving the nozzle surface 40A of the unit recording head 40 and of moving in the width direction by the moving mechanism 312.

Specifically, the moving mechanism 312 is basically constituted with a slider 314 supporting the common substrate 310 movably in the width direction, a driving motor 316 for moving the common substrate 310 on the slider 314 in the width direction, and a driving motor 318 for elevating the slider 314. The slider 314 has guides 320, which are provided on both ends in the conveying direction and extend in the width direction, and thereby the wiping members 88 are integrally movable in the width direction of paper through the common substrate 310 as guided by the guide 320.

A rack 322 extends from one end of the common substrate 310 and is engaged with a driver gear 326 directly connected to a driving motor 316 fixed to the casing 102. Accordingly, the wiping members 88 are integrally movable in the width direction of paper through the common substrate 310 on the slider 314 by the driving by the driving motor 316.

A protrusion 332 having a rack 330 formed thereon and extending in the vertical direction is provided on a lower surface of the slider 314, which is engaged with a driving gear 334 of the driving motor 318. Accordingly, the slider 314 can be elevated by driving the driving motor 318. Consequently, the wiping members 88 are integrally elevated through the common substrate 310 supported by the slider 314.

According to the constitution, the wiper 92 is moved by the moving mechanism 312 along the nozzle surface 40A of the unit recording head 40 as being in slidably contact with the nozzle surface 40A as shown in FIGS. 10A to 10C, whereby the entire nozzle surface 40A of the unit recording head 40 is cleaned.

At this time, the cap member 80 is disposed at a position opposite to the recording head 44, and therefore, the wiping member 88 is moved between the recording head 44 (i.e. the nozzle surface 40A) and the cap member 80.

For example, the constitution shown in FIG. 9 can be employed, in which upon moving the wiping member 88 between the recording head 44 (i.e., the nozzle surface 40A) and the cap member 80, the retaining member 90 of the wiping member 88 is moved over the cap member 80. The moving direction (moving in slidably contact therewith) of the wiper 92 may be, for example, the paper conveying direction (the direction shown by the arrow X) or a widthwise direction (the direction shown by the arrow Y) perpendicular to the paper conveying direction. The movement may be unidirectional or reciprocal.

The wiper 92 is moved with the moving unit 312 along the nozzle surface 40A of the recording head 44 as being in slidably contact with the nozzle surface 40A as shown in FIG. 10C, so as to effect cleaning of the entire nozzle surface. At this time, the cap unit 80 is disposed at a position opposite to the recording head 44, and therefore, the cleaning unit 88 is moved between the recording head 44 (i.e., the nozzle surface 40A) and the cap unit 80. For example, the constitution shown in FIG. 9 can be employed, in which the retaining member 90 of the cleaning unit 88 is formed into a gantry shape, and the wiper 92 is moved over the cap unit 80 as being pressed onto the nozzle surface 40A of the recording head 44.

The moving direction (moving in slidably contact therewith) of the wiper 92 may be, for example, the paper conveying direction or a widthwise direction perpendicular to the paper conveying direction. The movement thereof may be unidirectional or reciprocal.

The retaining member 90 for retaining the wiper 92 may be constituted with a metallic material having a certain strength, such as aluminum and stainless steel.

The wiper 92 preferably has, in order to obtain a prescribed stiffness, a rubber hardness of from 30 to 80, a ratio of a length in longitudinal (conveying) direction L1 and a width in crosswise (widthwise) direction W1 of from 5/1 to 50/1, and a width W1 of from 0.5 to 4 mm. In the case where the rubber-hardness is less than 30, the ratio of the length L1 and the width W1 is larger than 50/1, or the width W1 is less than 0.5 mm, the wiper 92 is too low in stiffness and cannot be sufficiency in contact with the nozzle surface 40A, so as to toughen the cleaning operation. In the case where the rubber hardness is larger than 80, the ratio of the length L1 and the width W1 is less than 5/1, or the width W1 is larger than 4 mm, the wiper 92 is too high in stiffness and cannot be sufficiently in contact with the nozzle surface 40A, so as to toughen the cleaning operation.

Examples of the rubber material constituting an elastic member used as the wiper 92 include various kinds of natural rubber and elastomers, such as caoutchouc, isoprene rubber, butadiene rubber, olefin rubber, ether rubber, polysulfide rubber, urethane rubber, fluorinated rubber and silicone rubber, as well as blended rubber of these rubber materials, and blended rubber of the rubber material and various kinds of plastics. These materials may be combined by adhesion or the like means.

Among these materials, hydrogenated nitrile butadiene rubber, ethylene propylene rubber (EPDM), polydimethylsilicone rubber, methylvinylsilicone rubber, methylphenylsilicone rubber and fluorosilicone rubber are preferred from the standpoint of weather resistance, chemical resistance, wear resistance and workability.

A thermoplastic elastomer excellent in fatigue resistance, molding resistance and rubber characteristics is also preferred.

The surface of the wiper 92 may be covered with a protective layer. The protective layer is preferably formed with a fluorine resin, which is excellent in liquid repelling property and low friction characteristics.

Various kinds of plastic materials may also be applied. Specific examples of the plastic material include molded articles of a polyester resin, such as polyethylene terephthalate and polybutylene terephthalate, a polyvinyl chloride resin, a polyvinylidene chloride resign, an epoxy resin, a polycarbonate resin, a polyethylene resin, a polypropylene resin and a polystyrene resin.

Such a material may also be used that is obtained by accumulating and adhering film articles of these materials, followed by accurately cutting. An adhesive used herein is preferably an acrylic polymer and a rubber polymer.

Figure 11:
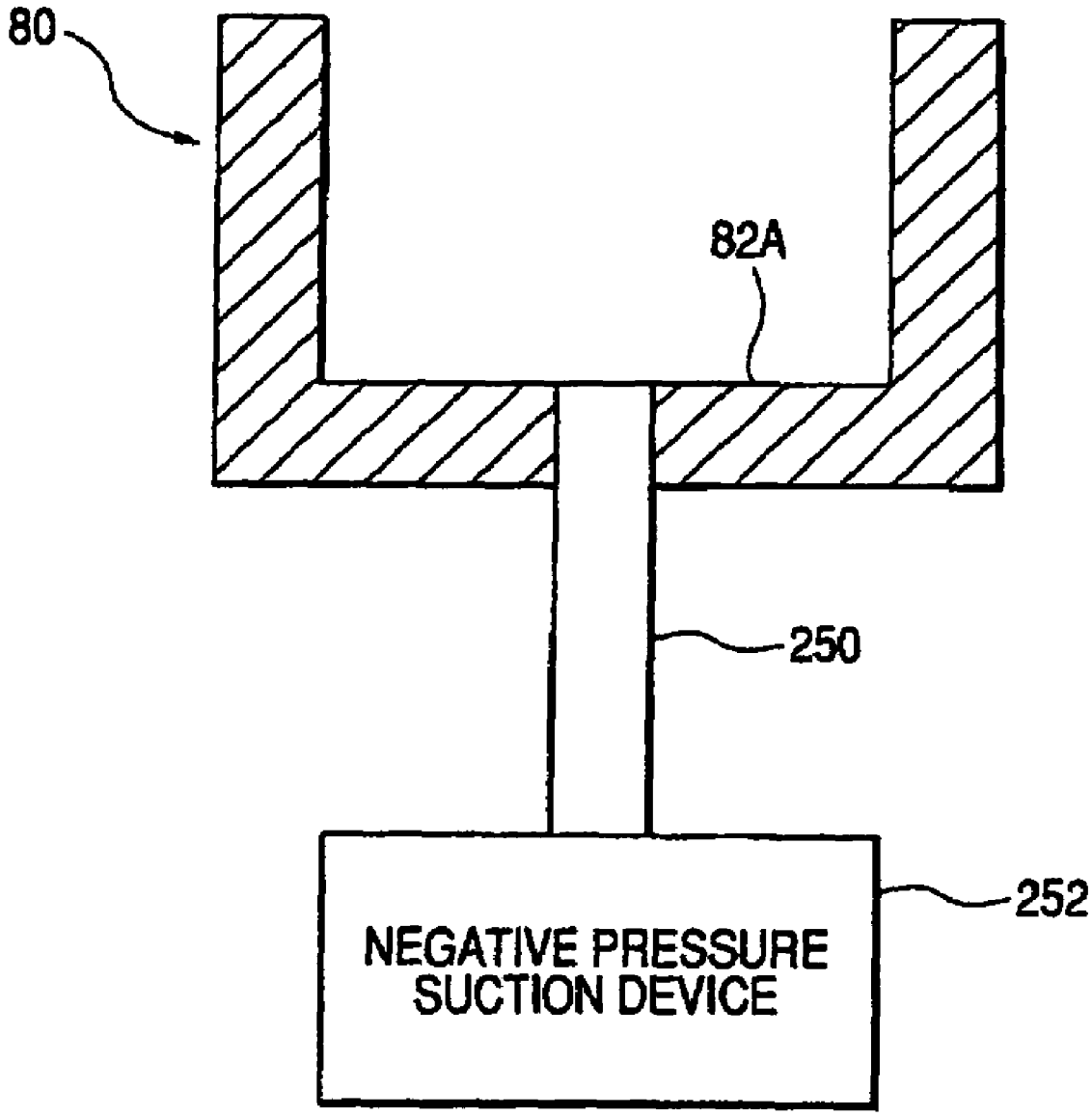
FIG. 11 is an explanatory view showing an example of a maintenance device according to an embodiment of the invention.

While the case where the ink absorbent 86 is used as a unit for recovering an ink (ink droplet) in this embodiment, it is not limited thereto. For, example, in the case of the constitution where the cap unit 80 can be pressed onto the nozzle surface 40A of the recording head 44, a negative pressure suction device 252 capable of applying a negative pressure is connected to the cap unit 80 (the concave part 82A) through a tube 250, as shown in FIG. 11, whereby the ink and dusts on the nozzle surface 40A of the recording head 44 and the ink having an increased viscosity in the nozzle are recovered upon pressing thereon, and the ink accumulated in the cap unit 80 (the receiving member 82) is recovered upon releasing therefrom.

Figure 12:
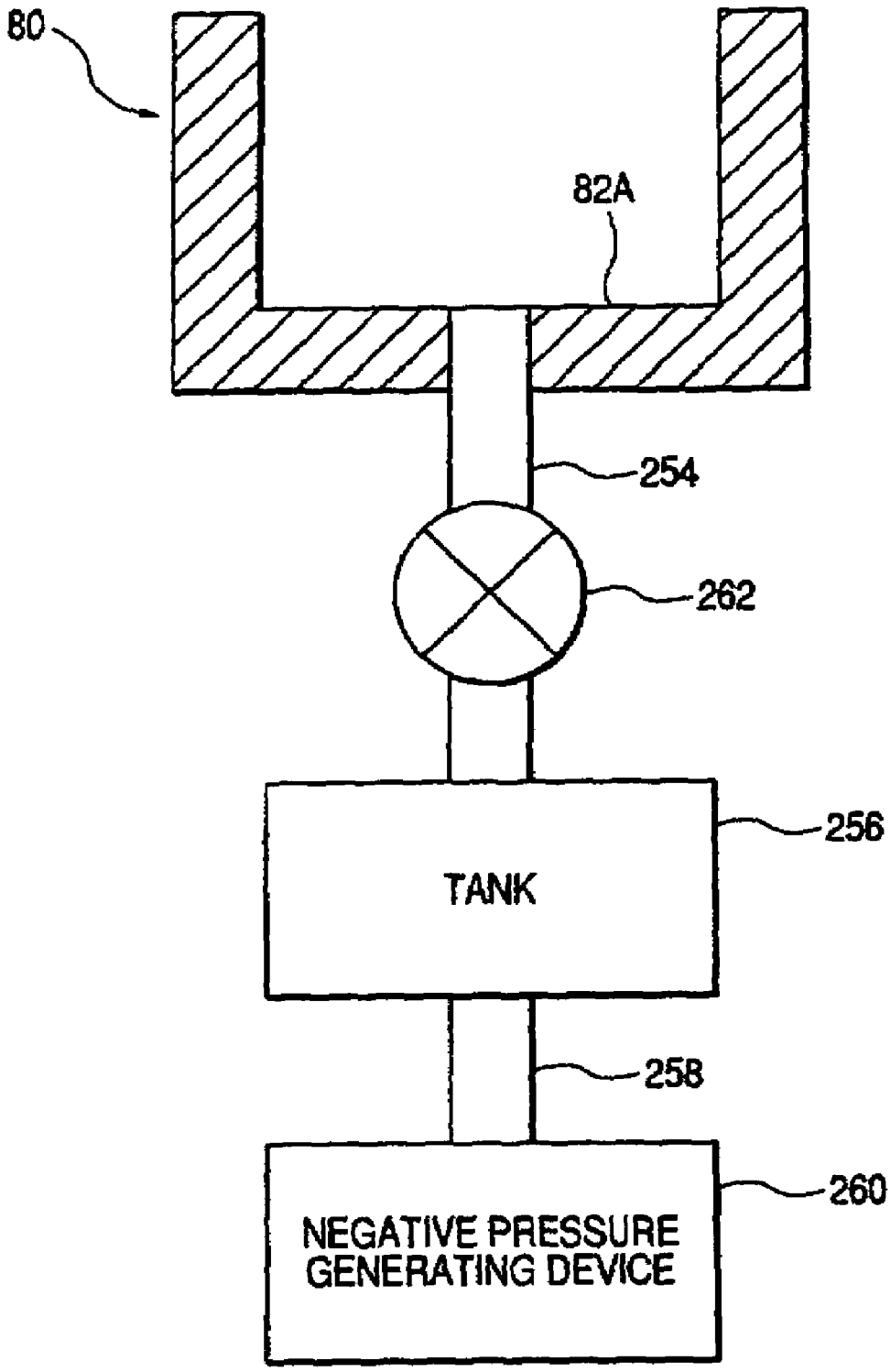
FIG. 12 is an explanatory view showing another example of a maintenance device according to an embodiment of the invention.

Specific examples of the constitution include that shown in FIG. 12 containing a tank 256 connected to the cap unit 80 (the concave part 82A) through a tube 254, and a negative pressure generating device 260 connected to the tank 256 through a tube 258 as shown in FIG. 12. An electromagnetic valve 262 is disposed between the cap unit 80 and the tank 256.

It is possible in this constitution that the negative pressure generating device 260 is driven to generate a negative pressure in the state where the electromagnetic valve 262 is closed, and at the time when the pressure in the tank 256 reaches about from −30 to −100 kPa with respect to the atmospheric pressure, the electromagnetic valve 262 is released, whereby the ink or the like in the concave part 82A of the cap unit 80 is sucked at once.

The function of the recording apparatus according to this embodiment of the invention thus constituted will be described.

The maintenance operation (dummy jet, wiping, capping and vacuuming) of the recording apparatus will be briefly described.

The dummy jet may be carried out at any time when no paper is present between the recording head 44 and the maintenance device 81. In other words, it may be carried out not only in the non-printing state, but also within a period between passage of preceding recording paper and arrival of subsequent recording paper during continuous printing of plural sheets of paper.

At the aforementioned timings, ink droplets are ejected from the respective nozzles without moving the recording head 44 from the printing position, whereby the ink droplets are housed in the cap unit 80. That is, the ink having an increased viscosity and the bubbles are ejected from the nozzles to initialize the ejecting performance of an ink droplet of the recording head 44. En the case where the cap unit 80 has the receiving member 82 having the concave part 82A, the ink droplets are housed and retained in the concave part 82A to prevent splash. In the case where the concave part 82A has an ink absorbent 86 inside, splash can be further certainly prevented, and the ink can be retained (recovered) through absorption.

Upon carrying out the dummy jet, the cap unit 80 and the cleaning unit 88 are not operated.

The wiping is carried out after printing but before conveying, or is carried out before printing. At this time, the cleaning unit 88, for example, the wiper 92 is in slidably contact with the nozzle surface 40A of the recording head 44 with the moving unit 312 as shown in FIG. 10C, whereby the ink and dusts on the nozzle surface 40A are removed to improve the ejecting performance of an ink droplet.

Since the cap unit 80 is disposed at a position opposite to the nozzle surface 40A, the cleaning unit 88 carries out the cleaning operation by moving to pass between the cap unit 80 and the nozzle surface 40A.

Figure 22:
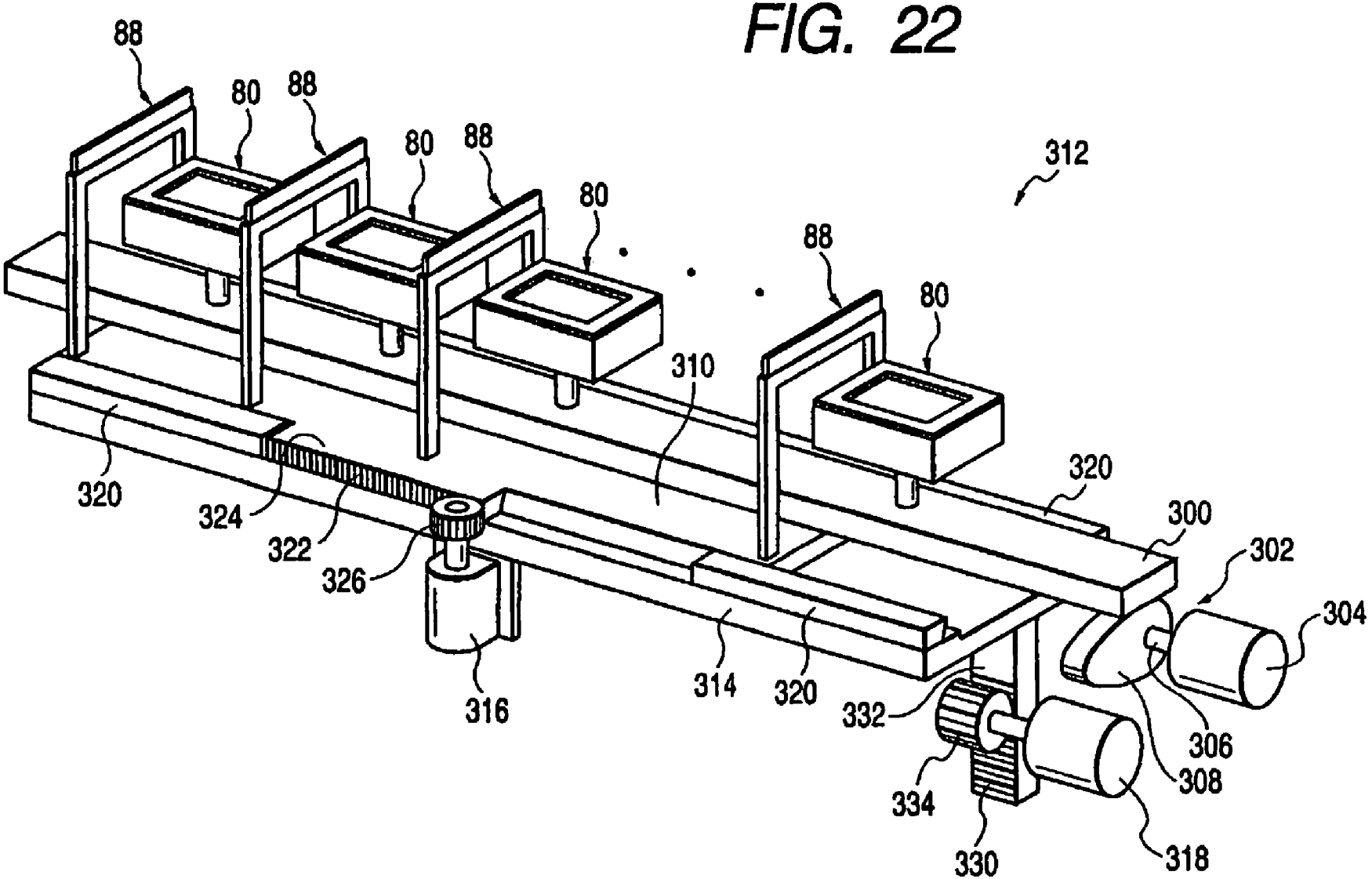
FIG. 22 is an explanatory view showing an elevating mechanism and a moving mechanism of a maintenance part according to Example 1 of the invention.

As shown in FIGS. 17 and 22, all the wiping members 88 corresponding the unit recording heads 40 constituting the recording head array, 42 are attached to the common substrate 310 and unitized, and they can integrally approach to and leave from the nozzle surface 40A of the unit recording head 40 with an elevating mechanism 312.

In the case of wiping members 88 cleaning the individual unit recording heads 40 in independent states, fluctuation occurs in operation of the wiping members 88 due to the complexity of the apparatus, whereby the cleaning operation becomes unstable, and the setting of the operation becomes difficult. In the case where the wiping members 88 are integrally moved for the recording head array 42 constituted by the plural unit recording heads 40 arranged in parallel, however, the constitution of the apparatus itself can be simplified to obtain stable cleaning operation.

While the wiping members 88 are moved in the width direction of the conveyed paper herein, the invention is not limited thereto, but they may be moved in the conveying direction (specific constitutions thereof will be described in Example 3) because it is sufficient that the wiping members 88 are integrally moved.

The capping operation is to prevent the ink in the nozzles of the recording head 44 from being dried and to prevent dusts from being attached to the nozzle surface 40A upon suspending the apparatus and in the non-printing state, and can be carried out only in the case where the cap member 80 can be elevated with an elevating mechanism 302, as shown in FIGS. 10A and 10B.

The capping is to prevent the ink in the nozzles of the recording head 44 from being dried and to prevent dusts from being attached to the nozzle surface 40A upon suspending the apparatus and on non-printing, and can be carried out only in the case where the cap unit 80 can be elevated with an elevating unit 302. The cap unit 80, for example, a rubber part 84 is pressed onto the nozzle surface 40A with the elevating unit 302 to maintain the nozzle surface 40A being sealed, whereby the nozzle surface 40A and the ink in the nozzles are prevented from being dried and increased in viscosity.

The vacuuming is to suck the ink in the nozzles of the recording head 44 and the ink retained by the cap unit 80, and is carried out upon non-printing. Specifically, the cap unit 80 is pressed onto the nozzle surface 40A with the elevating unit 302, and the negative pressure suction device 252 is driven (i.e., the negative pressure generating device 260 and the electromagnetic valve 262 are driven) to suck the ink in the nozzles and the ink retained by the cap unit 80, which are then recovered, for example, in the tank 256.

According to the series of maintenance operation having been described, the recording apparatus 200 can maintain good ink ejecting performance and can effect printing with high image quality.

Furthermore, there is no necessity of moving the recording head 44 from the printing position upon carrying out the maintenance operation. Therefore, the recording head 44 is prevented from suffering misalignment caused by moving the recording head 44 between the printing position and the maintenance position to fluctuate the printing quality, whereby the printing quality can be maintained constant. Moreover, no moving mechanism is required for the recording head 44, and thus the mechanism of the apparatus can be simplified.

In the case where the recording head 44 is constituted with plural unit recording heads 40, the plural maintenance devices 81 may be provided for the respective unit recording heads 40, or in alternative, the single maintenance device 81 may be provided for the plural unit recording heads 40.

In the case where the plural maintenance devices 81 are provided for the respective unit recording heads 40, the plural maintenance devices 81 (including the cap units 80 and the cleaning units 88) may be moved with a single set of an elevating unit 302 and a moving unit 312.

EXAMPLE 1

An ink-jet recording apparatus having a recording apparatus according to Example 1 of the invention will be described. The same constitutional elements as in the aforementioned embodiment are attached with the same symbols, and detailed descriptions thereof are omitted herein.

Overall Constitution of Ink-jet Recording Apparatus

The overall constitution of the ink-jet recording apparatus will be briefly described.

Figure 13:
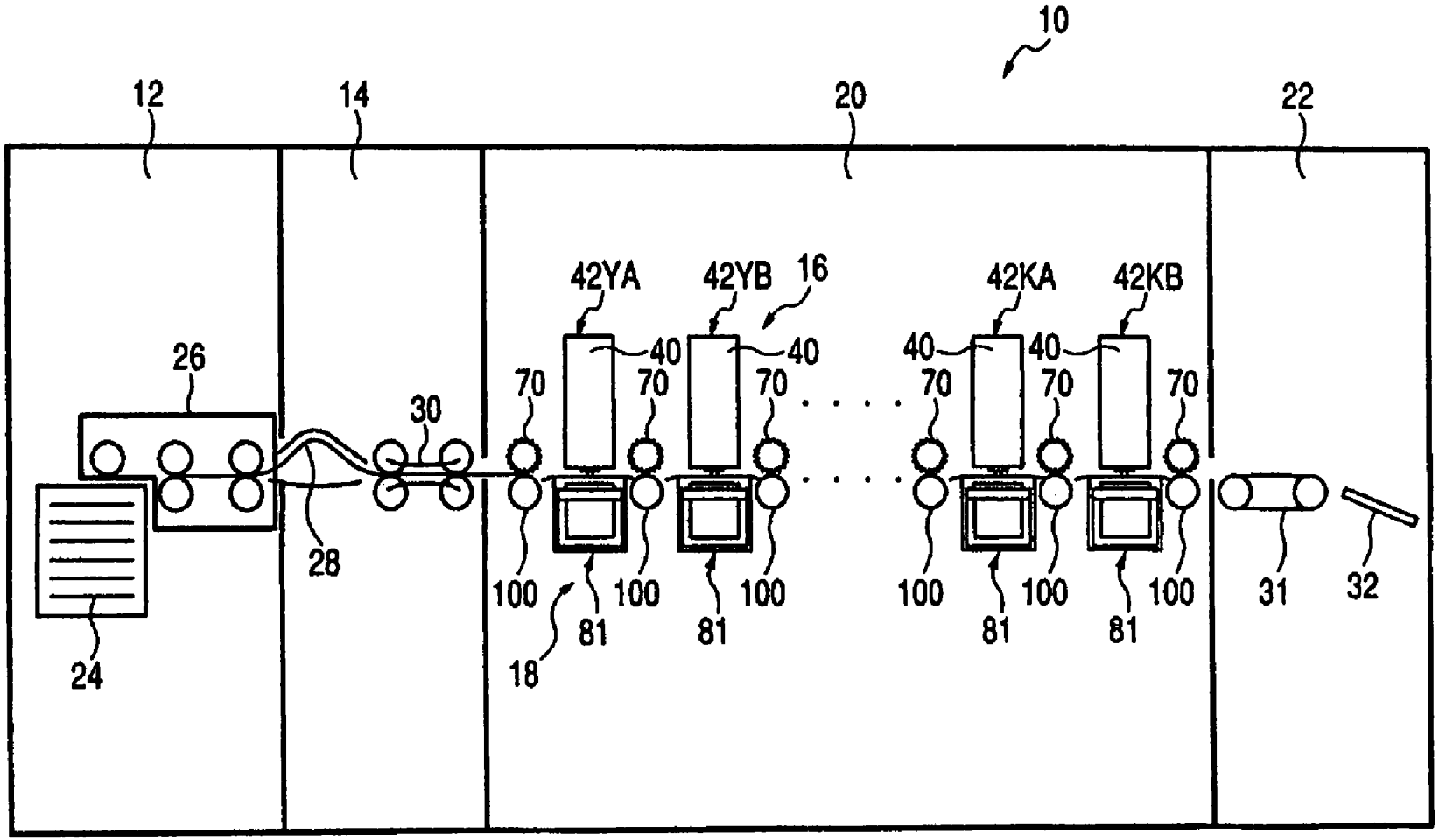
FIG. 13 is a schematic constitutional view showing a recording apparatus according to Example 1 of the invention.

As shown in FIG. 13, the ink-jet recording apparatus 10 is basically constituted with a paper feeding part 12 for dispatching paper, a registration adjustment part 14 for controlling the orientation of the paper, a recording, part 20 having a recording head part 16 for forming an image on the paper by ejecting ink droplets and a maintenance part 18 for carrying out maintenance of the recording head part 16, and a paper delivery part 22 for delivering the paper having an image formed thereon in the recording part 20.

The paper feeding part 12 is constituted with a stocker 24 having accumulated sheets of paper stocked therein, and a conveying device 26 for conveying a sheet of paper one by one from the stocker 24 to the registration part 14.

The registration part 14 has a loop forming part 28 and a guide member 30 for controlling tie orientation of the paper, and upon passing the paper through the registration part 14, skew of the paper is corrected, and the conveying timing is controlled to be fed to the recording part 20.

The recording part 20 has a paper conveying path, in which the paper is conveyed between the recording head part 16 and the maintenance part 18, and an image is formed on the paper, which is continuously (without stoppage) conveyed on the paper conveying path, by ejecting ink droplets from the recording head part 16 Pairs of the recording head part 16 and the maintenance part 18 are unitized, respectively, and the recording head part 16 is construed as being removably from the maintenance part 18 disposed opposite thereto with the paper conveying path intervening therebetween. Therefore, in the case of paper jam, jammed paper can be easily removed. The recording part 20 will be described in detail later, and descriptions thereof are omitted herein.

The paper delivery part 22 houses the paper having an image formed in the recording part 20 in a tray 32 through a paper delivery belt 31.

Constitution of Recording Head Part

Figure 14:
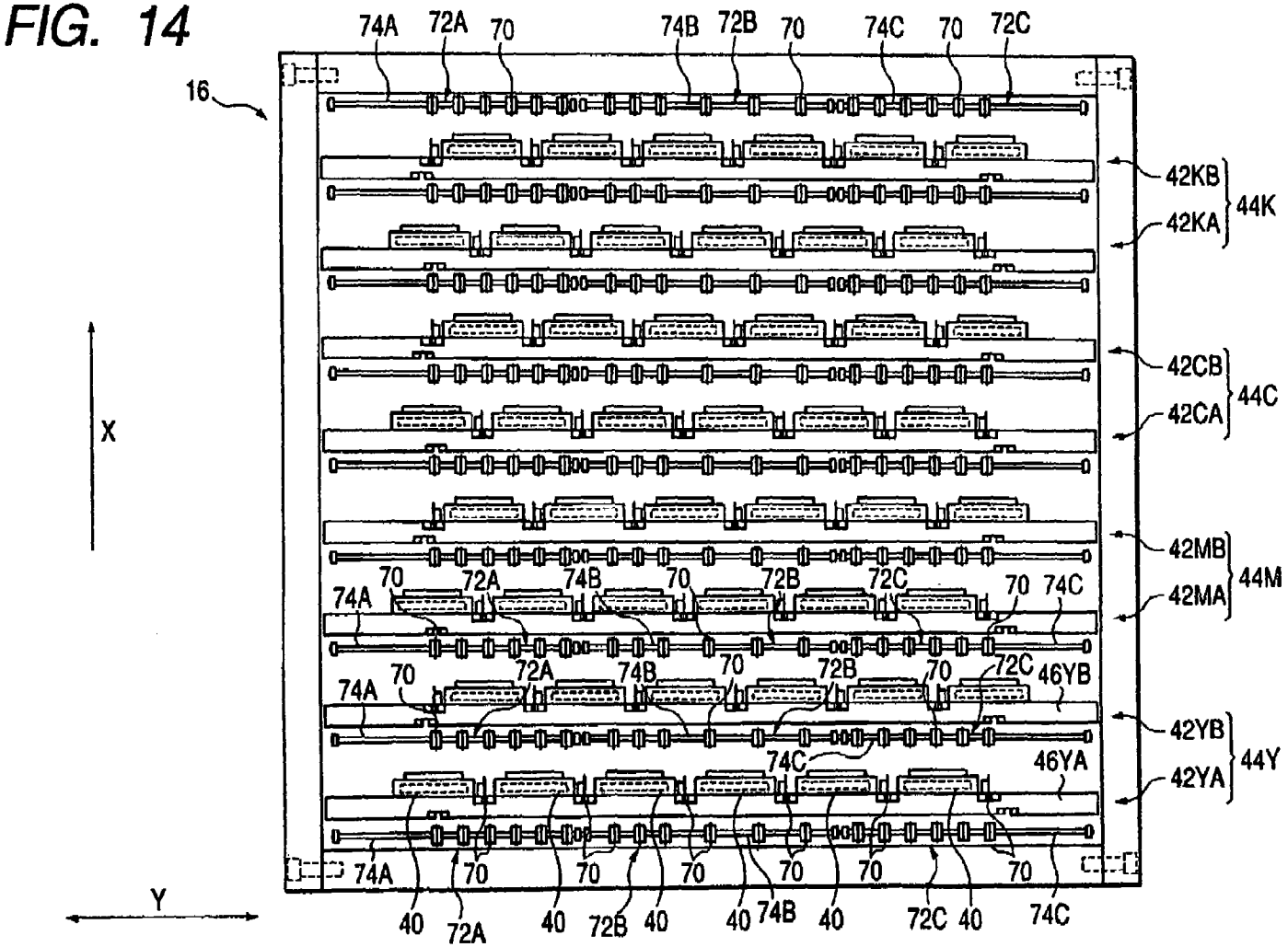
FIG. 14 is a schematic plane view showing a recording head part according to Example 1 of the invention.

The recording head part 16 will be described in detail with reference to FIGS. 14 to 19. FIG. 14 is a schematic plane view showing the recording head part 16 viewed from above. (The plane view from above is employed for the sake of convenience upon parallelizing with FIG. 20.)

As shown in FIG. 14, the recording head part 16 basically has eight recording head arrays 42 arranged in the paper conveying direction (the direction shown by the arrow X in the figure, which is hereinafter sometimes referred to as a conveying direction) at a constant interval, and each of the recording head arrays 42 has six unit recording heads 40 arranged in the paper width direction (the direction shown by the arrow Y in the figure, which is hereinafter sometimes referred to as a width direction) perpendicular to the conveying direction at a constant interval.

Figure 15:
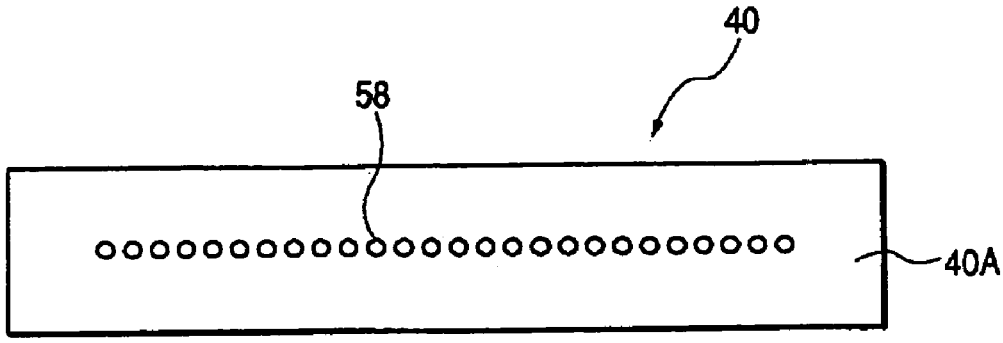
FIG. 15 is a plane view showing a unit recording head according to Example 1 of the invention.

As shown in FIG. 15, the unit recording head 40 has nozzles 58 for ejecting an ink arranged in a straight form on the nozzle surface 40A, ink droplets are ejected therefrom by a known thermal ink-jet system. In this example, the unit recording head 40 has 800 nozzles with a nozzle arrangement density of 800 dpi and an ejection frequency of 7.56 kHz and uses a pigment ink.

Six unit recording heads 40 are attached to a common substrate 46, which will be described later, in a straight form in such a manner that the nozzle arranging direction of the unit recording heads 40 agrees with the width direction, so as to form the recording head arrays 42A and 42B.

Figure 16:
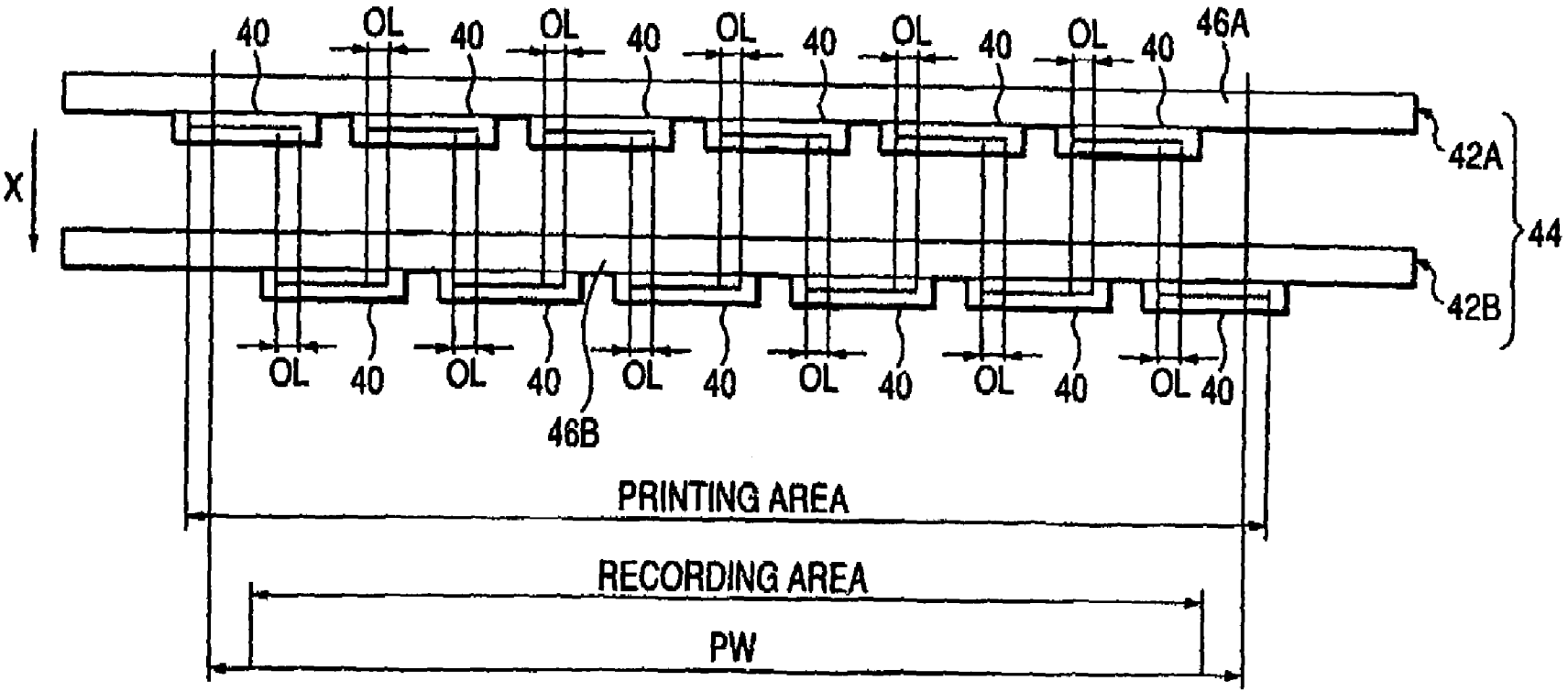
FIG. 16 is a constitutional explanatory view showing a recording head array according to Example 1 of the invention;.

As shown in FIG. 16, the recording head arrays 42A and 42B each has six unit recording heads 40 arranged at a constant interval, and the arrangement of the unit recording heads 40 is deviated in the width direction between the recording head arrays 42A and 42B, whereby the rows of nozzles of the unit recording heads 40 partly overlap each other between the recording head arrays 42A and 42B. The overlapping areas OL thus provided prevent formation of a non-printing area in the printing area The nozzles 58 of the unit recording heads 40 of the pair of recording head arrays 42A and 42B eject ink droplets to print an image of one color on the paper. In this example, a combination of the pair of recording head arrays 42A and 42B is referred to as a recording head 44.

The recording head 44 of this example has a printing area of 12 inches, which is wider than 297 mm, the shorter width of A3 size paper (i.e., the longer width of A4 size paper), which is the maximum paper width PW.

Plural recording heads 44 are arranged to print images of yellow (Y), magenta (M), cyan (C) and black (K) from the upstream of the conveying direction to attain full color printing, and symbols, Y, M, C and K, are attached to the reference number of the corresponding recording head (i.e., 44Y, 44M, 44C and 44K) depending on necessity to distinguish the recording heads, as shown in FIG. 14. The nomenclature is also applied to the other members.

In FIG. 14, because the recording heads 44Y, 44M, 44C and 44K have the same constitution, only constitutional elements of the recording head 44Y are attached with reference symbols, and reference symbols for constitutional elements of the other recording heads 44M, 44C and 44K are omitted.

As shown in FIG. 17, the recording head array 42A constituting the recording head 44 has six unit recording heads 40 attached at a prescribed interval to the common substrate 46A extending in the paper width direction.

In other words, the unit recording heads 40 are attached to the common substrate 46A, whereby the rows of nozzles are arranged in the width direction as shown in FIG. 16.

Figure 18:
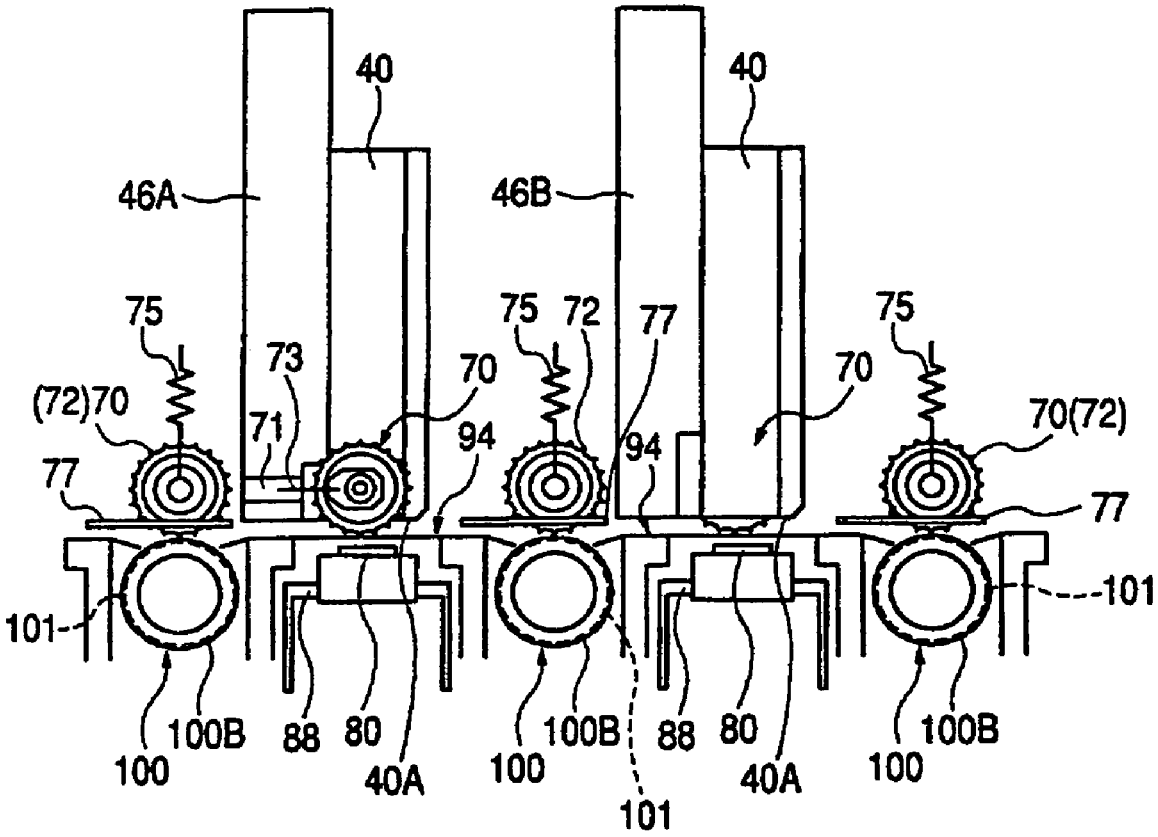
FIG. 18 is a side view of an important part of a recording part of Example 1 of the invention.

The recording head array 42A also has star wheels 70 adjacent in the width direction to the respective unit recording heads 40. The star wheel 70 is pivotally supported elastically at a tip end of a supporting member 71, which is engaged with the common substrate 46A through a blade spring 73, as shown in FIG. 18.

Figure 19A:
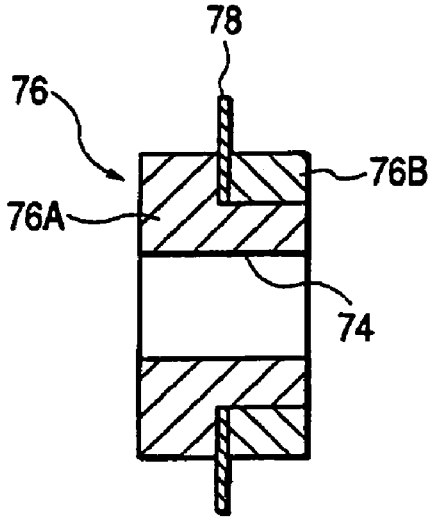
FIG. 19A is a cross sectional view showing a star wheel.

As shown in FIG. 19A, the star wheel 70 is constituted with a retaining member 76 formed with a resin having a cylindrical shape with a hole 74 formed therein, and a wheel 78 formed with stainless steel retained by the retaining member 76.

Figure 19B:
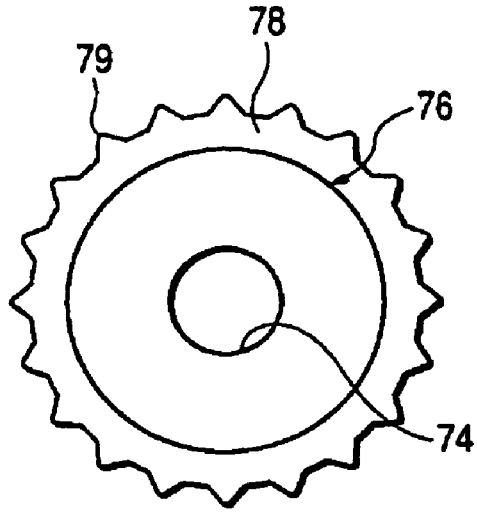
FIG. 19B is a side view thereof.
Figure 19C:
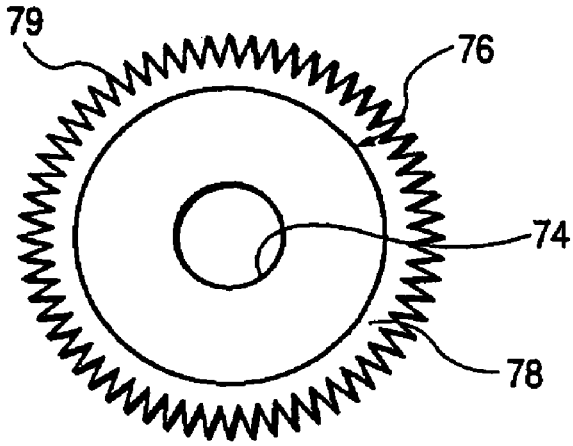
FIG. 19C is a side view of another example thereof.

The retaining member 76 is constituted with a first member 76A having a diameter reduced at a center in the axial direction to enable insertion of the wheel, and a second member 76B engaged in the part of the first member 76A having the reduced diameter to hold the wheel 78 associated with the first member 76A. The wheel 78 has a large number of teeth 79 on the outer periphery at a constant interval. The tooth 79 has an obtuse tip angle with a round tip end as shown in FIG. 19B, but such a shape is sufficient that has a reduced contact area as small as possible since it is in contact with an undried ink on the paper, and it may have, for example, an acute tip angle as shown in FIG. 19C.

The thickness of the wheel 78 in this example is 0.1 mm, which is thinned by tapering to about from 0.01 to 0.02 mm at the tip end (tooth top) thereof. The wheel 78 is produced with a stainless steel material, SUS631EH, through stepwise etching on both surfaces to process the tip end shape and the taper shape simultaneously, and has a fluorine resin water-repellent coating on the surface.

In the recording head part 16, groups of three star wheels 72A to 72C are arranged among the recording head arrays 42 along the conveying direction, on the upstream of the most upstream recording head array 42YA, and on the downstream of the most downstream recording head array 42KB, as shown in FIG. 14. The groups of star wheels 72A to 72C each has six star wheels 70 pivotally supported with a prescribed interval by three shafts 74A to 74C, which are continuously arranged in the width direction. The shafts 74A to 74C are biased on both ends thereof with a spring 75 to a conveying roll 100 described later. The displacement amount of the star wheel 70 is restricted with a restriction member 77 to such an extent that the star wheel 70 is stopped at a position slightly breaking into the surface of the conveying roll 100 as shown in FIG. 18.

The intervals of the star wheels 70 in the width direction are determined at 25.4 mm at most. This is because it is preferably 50 mm or less in order to suppress floatage and deformation locally occurring in the paper.

The force for pressing the star wheel 70 onto the conveying roll 100 with the spring 75 is 10 gf per one wheel. In the case where the pressing force is less than 5 gf, the paper cannot be sufficiently held on the conveying roll 100, and in the case where it exceeds 30 gf, the star wheel 70 damages the paper.

Constitution of Maintenance Part

Figure 20:
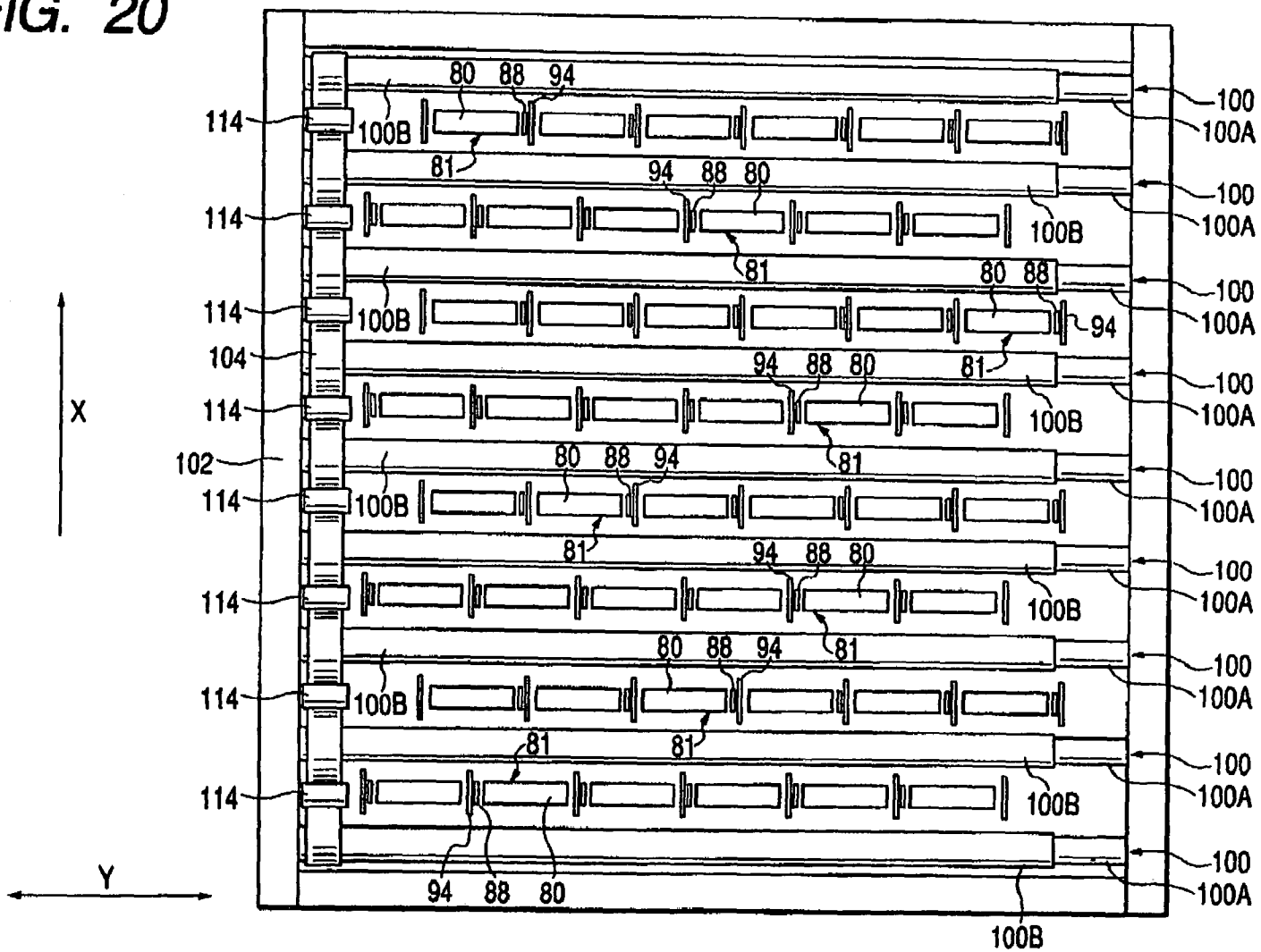
FIG. 20 is a schematic plane view showing a maintenance part according to Example 1 of the invention.

The constitution of the maintenance part 18 disposed opposite to the recording part 20 will be described with reference to FIGS. 20 to 25. FIG. 20 is a schematic plane view showing the maintenance part 18 viewed from the conveying position.

The maintenance part 18 is disposed opposite to the recording part 20 with the paper conveying position intervening therebetween, and as shown in FIG. 20, it has maintenance devices 81 arranged at positions opposite to the respective unit recording heads 40 of the recording part 20 as shown in FIG. 14. The maintenance device 81 is constituted with a cap member 80 and a wiping member 88.

Figure 21:
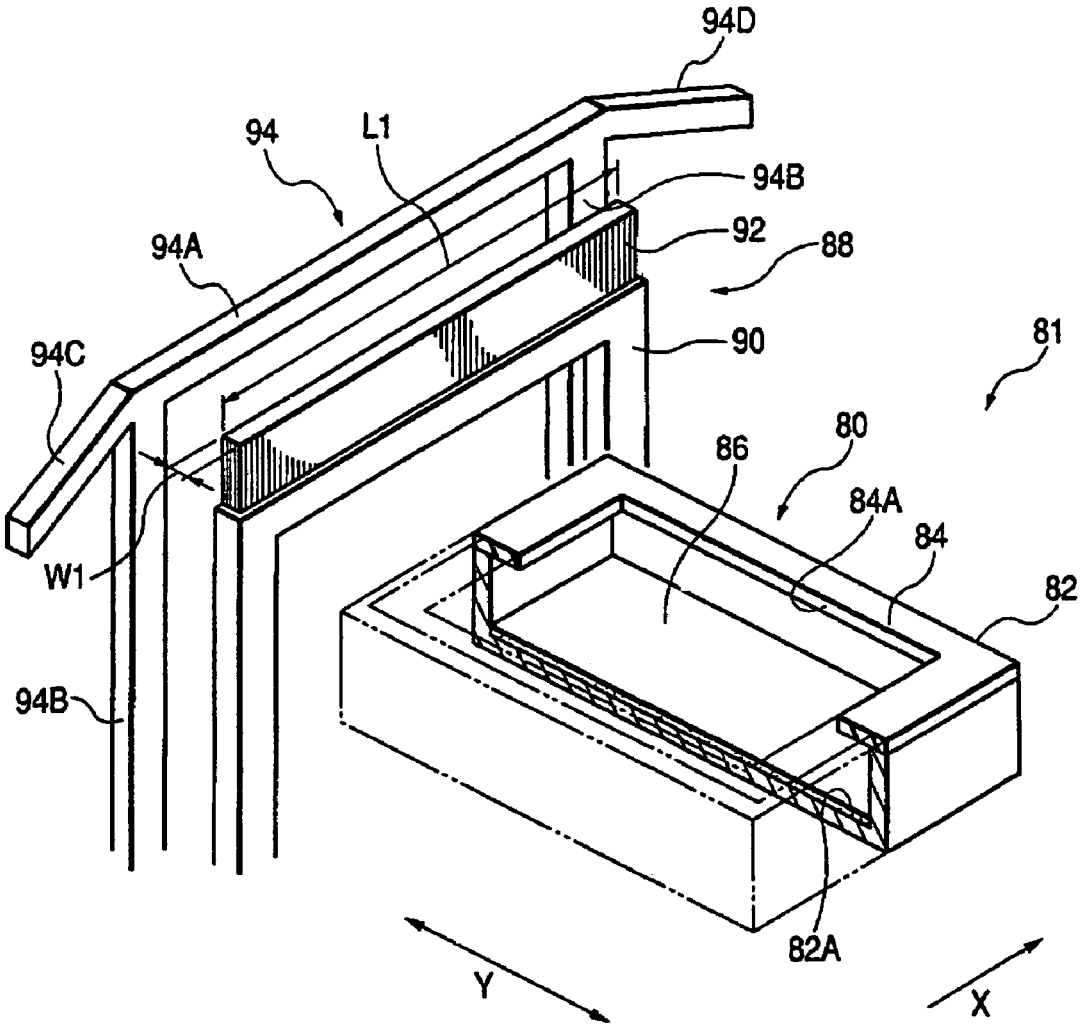
FIG. 21 is a perspective explanatory view showing an important part of a maintenance part according to Example 1 of the invention.

As shown in FIG. 21, the cap member 80 is constituted with a receiving member 82 formed with a PBT resin having a concave part 82A of a rectangular shape with a depth of 8 mm, a rubber member 84 formed with silicone rubber (having a hardness of 40 Hs) on an upper part of the receiving member 82, and an ink absorbent 86 formed with polypropylene and polyethylene disposed over the bottom of the concave part 82A. Therefore, upon carrying out dummy jet described later, ink droplets are ejected from the nozzles 58 of the respective unit recording heads 40 to the interior of the concave part 82A through an opening 84A of the cap member 80, and are absorbed with the ink absorbent 86.

As shown in FIG. 22, six cap members 80 corresponding to the unit recording heads 40 constituting the recording head array 42 are attached to a common substrate 300 and unitized, and they are constituted as they can integrally approach to and leave from the nozzle surface 40A of the unit recording head 40 with an elevating mechanism 302.

The elevating mechanism 302 is constituted with a driving motor 304 and an eccentric cam 308 attached to a driving axis 306 of the driving motor 304 and in contact with a lower surface of the common substrate 300. Accordingly, the eccentric cam 308 is rotated upon driving the driving motor 304, and thus the common substrate 300 in contact with the eccentric cam 308 approaches to and leaves from the nozzle surface 40A of the unit recording head 40.

The cap member 80 has, on the lower surface thereof, a spring 87 for adjusting the pressing force upon contacting with the nozzle surface 40A as shown in FIG. 26. Accordingly, upon capping operation described later, the cap member 80 is rises, and the rubber member 84 is pressed onto the nozzle surface 40A to seal the nozzle surface 40A including the nozzles 58, whereby drying of the ink is suppressed, and attachment of dusts is prevented. Furthermore, upon wiping operation described later, the cap member 80 descends, whereby the wiping member 88 is made movable in the width direction.

The wiping member 88 for cleaning the nozzle surface 40A of the unit recording head 40 is disposed at a position adjacent in the width direction to the cap member 80 as shown in FIGS. 21 and 22.

As shown in FIG. 21, the wiping member 88 is constituted with a retaining member 90 having a substantially gantry shape as viewed from the width direction, and a wiper 92 disposed on an upper part of the retaining member 90 and extending in the conveying direction.

The wiper 92 is formed with a thermoplastic polymer resin (having a hardness of 65 Hs) and has a length in the conveying direction L of 8 mm, a thickness in the width direction W1 of 0.8 mm and a height from the retaining member 90 (free length) of 6 mm.

The retaining member 90 is formed with a stainless steel material.

The wiping member 88 is disposed at a position at 1 mm from the end of the cap member 80 in the width direction.

As shown in FIG. 22, all the wiping member 5 88 corresponding to the respective unit recording heads 40 constituting the recording head array 42 are attached to a common substrate 310 and unitized, and they are constituted as they can integrally approach to and leave from the nozzle surface 40A of the unit recording head 40 with a moving mechanism 312 and are movable in the width direction.

The moving mechanism 312 is basically constituted with a slider 314 supporting the common substrate 310 movably in the width direction, a driving motor 316 for moving the common substrate 310 on the slider 314 in the width direction, and a driving motor 318 for elevating the slider 314. The slider 314 has guides 320, which are provided on both ends in the conveying direction and extend in the width direction, and the common substrate 310 guided with the guides 320 is movable in the width direction. Protrusions 324 constituting a rack 322 are formed on one side surface of the common substrate 310, with which a driving gear 326 of the driving motor 316 attached to the slider 314 is engaged. Accordingly, the common substrate 310 is movable on the slider 314 in the width direction by driving the driving motor 316.

Protrusions 332 constituting a rack 330 extending in the vertical direction are provided on a lower surface of the slider 314, with which a driving gear 334 of the driving motor 318 is engaged. Accordingly, the slider 314 can be elevated by driving the driving motor 318. That is, the common substrate 310 and wiping members 88 supported by the slider 314 are integrally elevated.

Figures 23A, 23B, 23C, 23D, 23E, 23F, 23G:
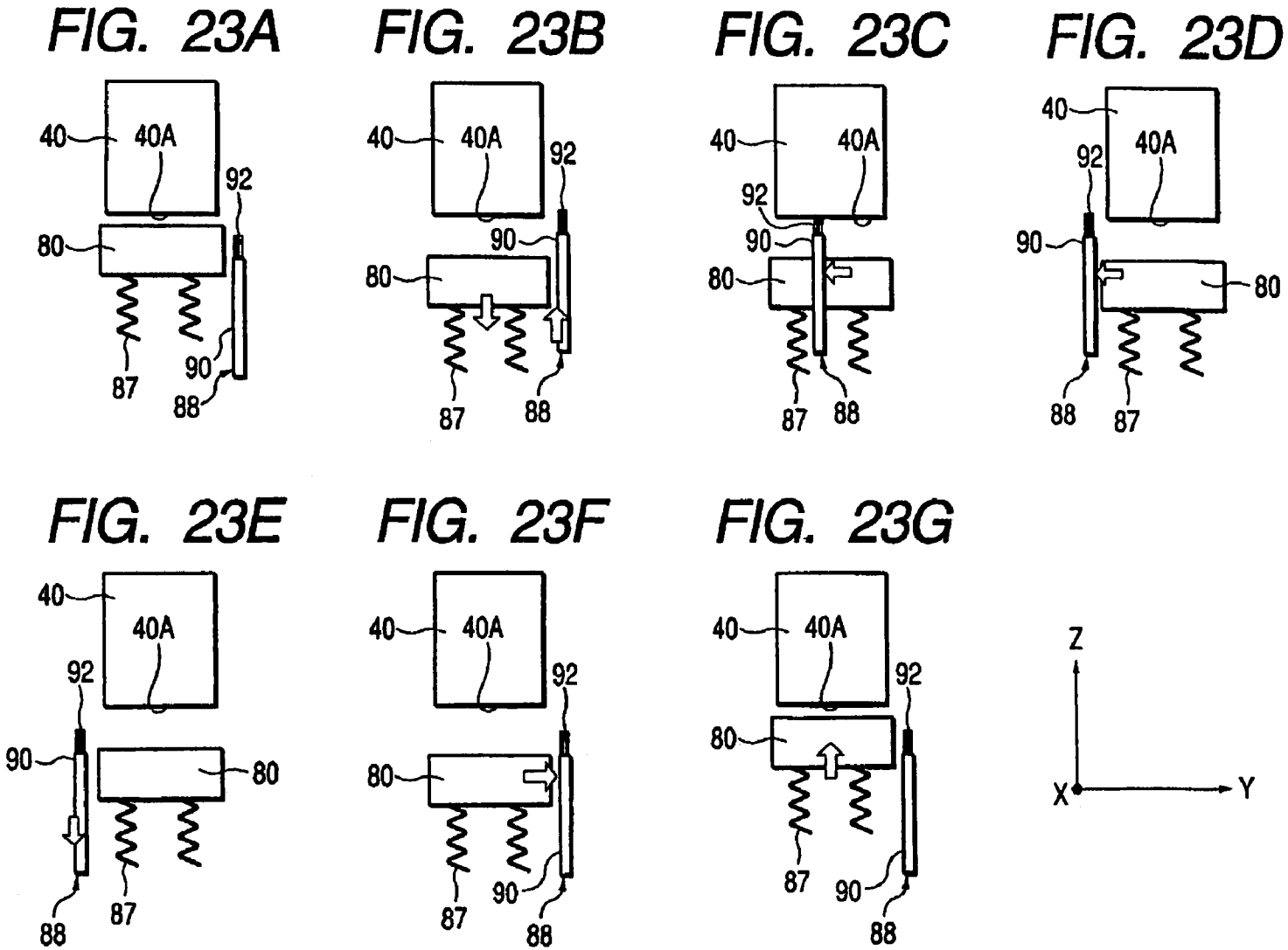
FIGS. 23A to 23G are operational explanatory views showing wiping operation in a recording apparatus according to Example 1 of the invention.

According to the constitution, the wiping members 88 can approach to and leave from the nozzle surface 40A and are movable in the width direction with the moving mechanism 312. That is, the wiping member 88 (wiper 92) in the home position is disposed at a position lower than the cap member 80 to prevent from interfering the paper thus conveyed (as shown in FIG. 23A), and upon wiping, it rises and moves in the conveying direction by overstriding the cap member 80 thus descending from the home position to effect wiping (as shown in FIG. 23C).

In order to prevent the paper penetrating into the concave part 82A of the cap member 80 upon conveying the paper in the recording part 20, guide members 94 are provided on both sides of the cap member 80 in the width direction as shown in FIG. 21. The guide member 94 is formed with a stainless steel material and constituted with a horizontal part 94A extending in the conveying direction, two vertical parts 94B extending from both ends of the horizontal part 94A in the vertical downward direction, and guide parts 94C and 94D extending from both ends in the conveying direction of the horizontal part 94A in the obliquely downward direction toward the conveying direction as shown in FIG. 21.

The horizontal part 94A of the guide member 94 is disposed opposite to the star wheel 70 disposed between the unit recording heads as shown in FIGS. 14, 20 and 18). Accordingly, the paper thus conveyed is in contact with the guide member 94 (horizontal part 94A) by the star wheel 70 at the printing position in the conveying direction, whereby the distance between the nozzle surface 40A and the paper deformed by attachment of an ink or the like is maintained constant as shown in FIG. 18.

Subsequently, the home position of the respective members constituting the maintenance device 81 in this example (i.e., the position where no maintenance is carried out on the unit recording head 40 during image printing) will be described.

The cap member 80 is disposed under the nozzle surface 40A of the recording head 40, whereby the rubber member 84 covers, in plane view, the entire nozzle surface 40A of the unit recording head 40, and all the nozzles 58 of the unit recording head 40 are positioned, in plane view, within the opening 84A of the rubber member 84.

The wiping member 88 is disposed in such a manner that the tip end of the wiper 92 is positioned under the nozzle surface 40A of the unit recording head 40, and disposed at such a position in that the longitudinal direction (in the conveying direction) of the wiper 92 covers, in plane view, the entire width in the conveying direction of the nozzle surface 40A of the unit recording head 40, and the wiper 92 is placed at a position apart from the end in the width direction of the unit recording head 40 by 1 mm (i.e., such a position in that the wiper can clean the recording head in the shorter width direction thereof).

The guide member 94 is disposed in such a manner that the uppermost surface of the horizontal part 94A, which is in contact with the paper, is positioned under the nozzle surface 40A of the unit recording head 40, and disposed at such a position in that the length in the conveying direction of the horizontal part 94A of the guide member 94 covers, in plane view, the nozzle surface 40A of the unit recording head 40, and the uppermost surface of the horizontal part 94A, which is in contact with the paper, is placed at a position apart from the end in the width direction of the unit recording head 40 by 2 mm.

Subsequently, a mechanism for conveying the paper between the maintenance device 81 and the unit recording head 40 will be described.

Conveying rolls 100 for conveying the paper by transmitting a driving force thereto are disposed at both ends in the conveying direction and between the cap members 80 adjacent to each other in the conveying direction in the maintenance part 18 as shown in FIG. 20. The conveying rolls 100 are disposed as corresponding to the disposed positions of the groups of star wheels 72A to 72C as shown in FIG. 18, and the paper is made in contact with the conveying rolls 100 with the star wheels 70 of the groups of star wheels 72A to 72C, which are elastically pressed onto the side of the conveying rolls 100 with the springs 75, so as to transmit the driving force from the conveying rolls 100 to the paper.

The conveying roll 100 is constituted with a small diameter part 100A supported pivotally with a casing 102, and a large diameter part 100B, which has a larger diameter than the small diameter part 100A and is in contact with the star wheel 72, as shown in FIG. 17. The conveying roll 100 transmits the driving force to the paper through the large diameter part 100B, and is preferably those that have a large friction coefficient and are difficultly worn. The conveying roll 100 in this example is constituted with a metallic roll (SUS303) with a diameter of 10 mm having ceramic fine powder mainly containing alumina spray-coated thereon, followed by sintering, and satisfies the aforementioned requirements. The spray-coating is applied not only to the printing area of the large diameter part 100B of the conveying roll 100, which is in contact with the paper, but also to the non-printing area thereof, which is in contact with a flat belt 104.

In order to prevent the tooth tops of the star wheel 70 from being deformed by contacting with the surface of the conveying roll 100, a groove 101 having a width of 2 mm and a depth of 2 mm is provided at a part of the conveying roll 100 opposite to the star wheel 72 as shown in FIG. 18. Furthermore, in order to prevent the paper conveying resistance from being increased upon increasing the penetrating amount of the star wheel 72 into the groove 101, a restriction member 77 for restricting the penetrating amount of the star wheel 72 is provided as shown in FIG. 18.

Figure 24:
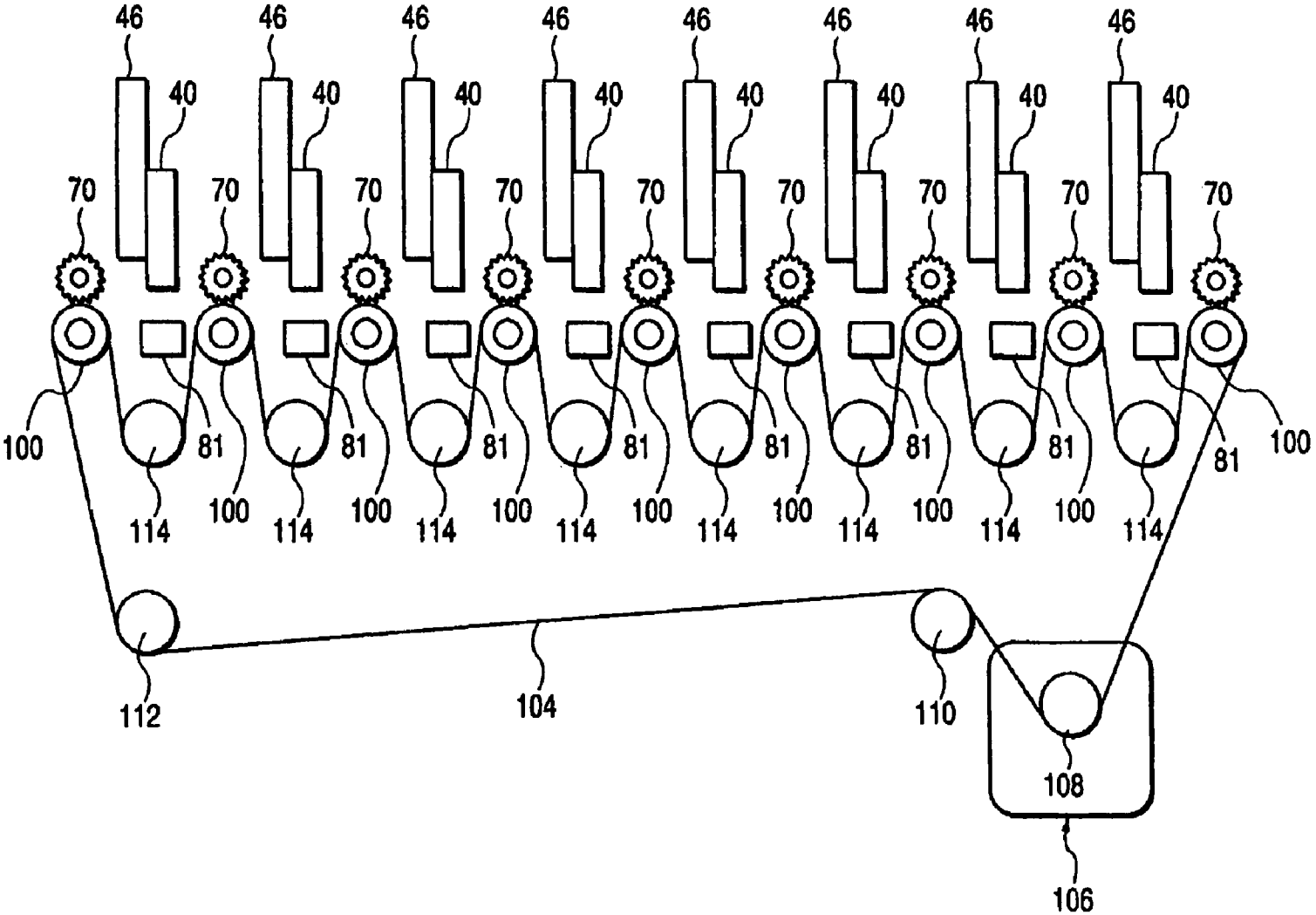
FIG. 24 is an explanatory view showing a driving mechanism of a recording apparatus according to Example 1 of the invention.

As shown in FIG. 24, the driving mechanism for driving the conveying rolls 100 is constituted in such a manner that a flat belt 104 is stretched and wound on a driving shaft 108 of a single motor 106 to all the conveying rolls 100 through idler rolls 110 and 112. Idler rolls 114 are disposed between the conveying rolls 100 adjacent to each other to ensure a wound angle of the flat belt on the respective conveying rolls 100 (large diameter parts 100B).

Figure 25:
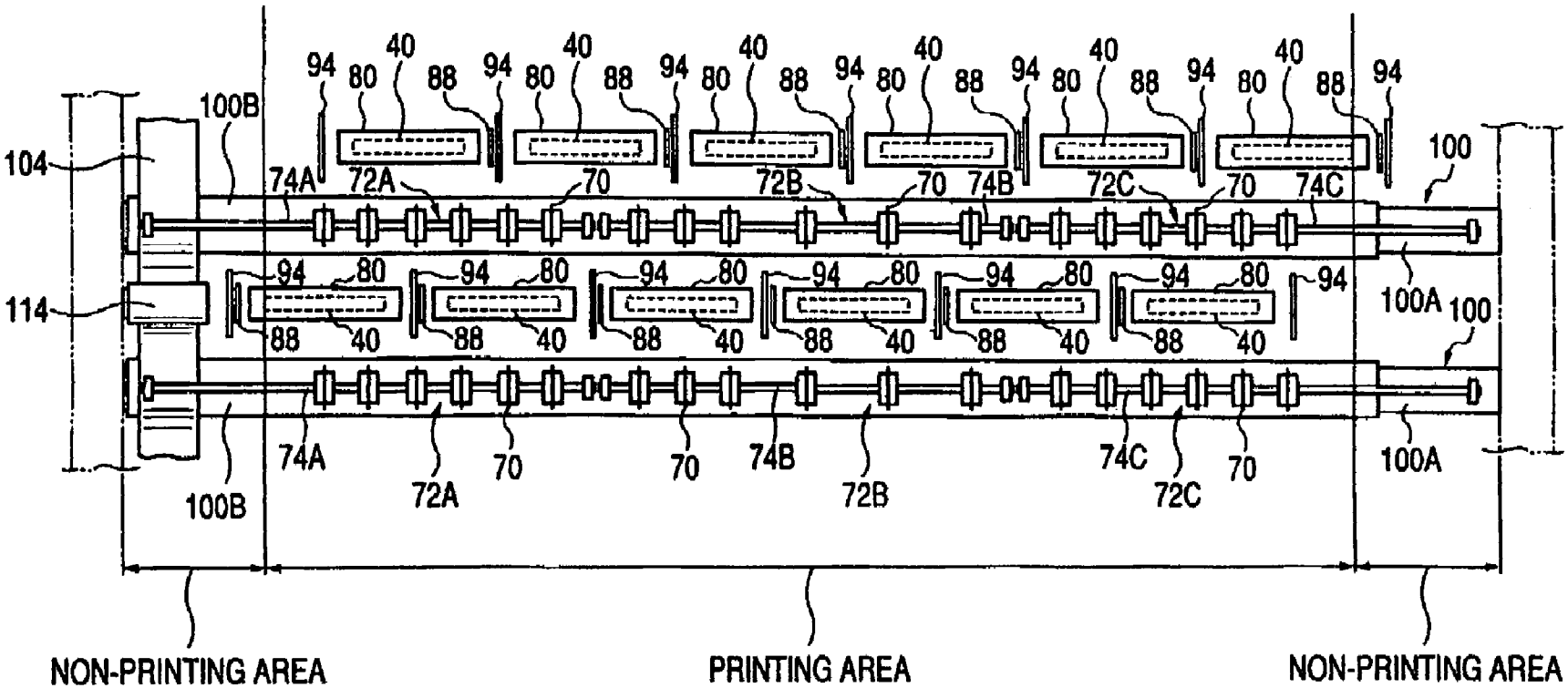
FIG. 25 is a plane explanatory view showing an important part of a paper conveying mechanism according to Example 1 of the invention.

As shown in FIG. 25, the flat belt 104 is wound on the non-printing area outside the printing area in the large diameter part 100B of the conveying roll 100, with which the paper is in contact.

The single motor 106 is employed because of the following reason. In the case where plural motors are employed, the driving velocity and the fluctuation characteristics thereof of the respective motors are difficult to be made strictly uniform, and as a result, the fluctuation components in velocity are accumulated on the paper velocity, whereby the velocity fluctuation of the paper causes problems by accumulation of the velocity fluctuation of the motors even though the velocity fluctuation of the respective motors is sufficiently low. That is, the plural conveying rolls 100 are driven by the single driving source (ie., the motor 106), whereby the conveying velocity of the paper is made uniform to attain printing with high quality.

The flat belt 104 transmits the driving force to the conveying rolls 100 without engagement of teeth (with a frictional force), and therefore, it is particularly preferred since no periodical velocity fluctuation by every teeth occurs.

The flat belt 104 in this example has a thickness of 0.4 mm and is constituted with a base material formed by weaving polyester fibers having a thin film coating of polyurethane formed on one surface thereof, so as to attain both high mechanical strength and high friction.

According to the recording part 20 thus constituted in this example, the distance between the nozzle surface and the paper is designed to be 1.5 mm, and the paper is horizontally conveyed between them. The maximum recording area (i.e., the maximum paper width PW), to which the printing operation is applied, is a shorter width of A3 size paper (i.e., the longer width of A4 size paper). The recording part 20 has a process velocity of 240 mm/s, a printing resolution of 800×800 dpi, and a recording speed of 60 sheets per minute (in the case of long edge feed of A4 size paper (A4LEF)).

The function of the ink-jet recording apparatus 10 thus constituted as described in the foregoing will be described.

The printing operation and the maintenance operation (dummy jet, wiping and capping) will be sequentially described.

The printing operation will be firstly described. Upon-carrying out the printing operation, paper is fed from the paper feeding part 12, and after controlling the orientation and the timing of the paper in the registration adjustment part 14, the paper is dispatched to the recording part 20.

In the recording part 20, the motor 106 is driven, and the driving force is transmitted to all the conveying rolls 100 through the flat belt 104.

Accordingly, the paper reaching the recording part 20 is inserted between the conveying roll 100 and the group of star wheels 72A to 72C disposed at the most upstream position in the conveying direction. At this time, the star wheel 70 of the group of star wheels 72A to 72C biased with the spring 75 presses the paper onto the conveying roll 100, whereby the conveying force is certainly transmitted from the conveying roll 100 to the paper, and thus the paper is inserted into the lower part of the unit recording head 40 at a constant velocity. Subsequently, the driving force is sequentially transmitted from the conveying rolls 100 between the recording head arrays 42 to convey the paper.

Because all the conveying rolls 100 are driven with the single motor 106, the paper is conveyed at a constant velocity, but it is prevented that accumulated velocity fluctuation of plural driving sources causes fluctuation of the conveying velocity of the paper as in the case where the conveying rolls are driven with plural driving sources. Periodic velocity fluctuation causing an image defect that can be visually recognized on an image is often caused by a problem on processing accuracy of teeth of gears, but because the flat belt 104 is used in this example for transmitting the driving force (without the use of engagement of teeth), such an image defect is prevented from occurring. Furthermore, because the flat belt 104 is wound on the non-printing area of the large diameter part 100B of the conveying roll 100 in contact with the paper, no periodic velocity fluctuation occurs even in the case where the conveying roll 100 causes eccentricity due to the processing accuracy or the retaining system (such as bearings), and thus the paper is conveyed at the moving velocity (constant velocity) of the flat belt 104. In the constitution where the idler roll 114 is disposed to ensure the wound angle of the flat belt 104, periodic velocity fluctuation occurs due to the processing accuracy or the retaining system of the idler roll 114 in the strict sense, but the idler roll 114 can be easily processed with high accuracy at low cost because it has a relatively small size and may be formed with a single material. The conveying roll 100, on the other hand, has a large size and has a constitution containing plural materials including, for example, the core metal and the covering material, and therefore, it is difficult to be processed with high accuracy or becomes a considerably expensive member. The driving system using surface friction with the flat belt 104 has such an effect that even in the case where fluctuation in the radius and the rotational center of the conveying roll 100 occurs, no periodic fluctuation in velocity is caused thereby.

Furthermore, because the group of star wheels 72A to 72C is divided into three parts in the width direction to reduce the length of the shafts 74A to 74C thereof, deflection of the shafts can be prevented to press the paper evenly with the plural star wheels 70 biased with the springs 75. Accordingly, the driving force can be evenly transmitted to the paper.

In particular, because the paper is pressed onto the conveying roll 100 with the star wheels 70, the driving force is certainly transmitted to the paper to ensure conveying at a constant velocity. In particular, owing to the nonuse of an electrostatic sorption system, stable conveying can be attained irrespective to the thickness and the material of the paper.

Moreover, because the star wheel 70 is disposed between the unit recording heads 40 in the width direction, and the guide member 94 is disposed at a position opposite thereto, floatage and the like of the paper can be prevented at the printing position (at the recording head array 42) in the conveying direction, whereby the planarity of the paper (i.e., a constant distance to the nozzle surface 40A) is ensured.

In other words, the provision of the star wheel 70 ensures the planarity of the paper (i.e., a constant distance to the nozzle surface 40A) even in the case where the maintenance device 81 including the cap member 80 and the like is disposed at the position opposite to the unit recording head 40.

Upon inputting a printing signal to the unit recording heads 40 of the recording head part 16 from a controlling part of the apparatus, a heating element of the nozzle corresponding to the printing signal generates heat, whereby an ink droplet is ejected from the nozzle to the paper conveyed with a constant distance to the nozzle surface 40A.

Accordingly, printing is carried out with the recording head array 42A, and subsequently, printing is carried out with the recording head array 42B, so as to complete printing in one color on the corresponding part of the paper. Upon conveying the paper in the recording part 20, printing is sequentially carried out with the recording heads 44Y, 44M, 44C and 44K to effect full color printing.

As described in the foregoing, the planarity of the paper (i.e., a constant distance to the nozzle surface 40A) is ensured, and printing is carried out on the paper conveyed at a constant velocity, whereby an image of high image quality can be formed. In particular, because the planarity is stably ensured with the star wheel 70 during conveying in the recording part 20, deformation caused during printing on various kinds of paper having variation in thickness can be favorably corrected, and thus the distance to the nozzle surface 40A can be maintained to a constant value to attain printing with high image quality.

In particular, in the recording part 20, the conveying rolls 100 are disposed between the recording head arrays 42 and also disposed on the upstream of the most upstream recording head array 42YA and on the downstream of the most downstream recording head array 42KB, and the plural conveying rolls 100 are driven with the single driving source. Consequently, the paper is certainly conveyed at a constant velocity to attain printing with high image quality.

The operation of dummy jet will be then described.

The dummy jet is carried out upon non-printing or after every times of completion of printing of a prescribed number of sheets during continuous printing of plural sheets of paper but before reaching an edge of subsequent paper. That is, ejection of an ink droplet is carried out from an arbitrary nozzle among all the unit recording heads 40 constituting the recording heads 44Y to 44K to the cap member 80 (i.e., so-called dummy jet). The dummy jet may be carried out for all the nozzles of all the unit recording heads 40, for all the nozzles 58 of the selected unit recording head 40 or the selected recording head array 42, or only for such a nozzle 58 that has not ejected an ink droplet for a prescribed period of time.

For example, the distance between the nozzle surface 40A and the upper surface of the cap member 80 upon carrying out the dummy jet during continuous printing of plural sheets of paper is set at 3 mm, and 500 droplets are ejected from all the nozzles, respectively, at the time between passage of preceding recording paper and arrival of subsequent recording paper by 30 sheets pf A4 size paper.

At this time, the provision of the ink absorbent 86 at the bottom of the concave part 82A of the cap member 80 prevents the thus-ejected ink from suffering flood and splash from the concave part 82A.

For example, the change in ejection performance due to drying of an ink (particularly, an aqueous ink and a solvent ink) can be initialized by ejecting ink droplets (dummy jet) from all the nozzles of the unit recording head 40. Even in the case of an oily ink and a solid ink, which are substantially not dried, the dummy jet can remove bubbles attached to the ink flow path inside the head and dusts attached on the nozzle surface upon printing, whereby the ejection performance of ink droplets of the nozzles can be initialized.

The printing speed (productivity) is improved in this example because the dummy jet can be carried out during continuous printing of plural sheets of paper thus conveyed without movement of the recording head 44 and the cap member 80. Furthermore, the printing performance of the recording head 44 can be constantly maintained by the dummy jet to enable printing with high image quality.

The wiping operation will be described.

The wiping operation is carried out before starting printing. The recording head 40 (nozzle surface 40A) is wiped with the wiping member 88 of the maintenance part 18. The specific operation will be described based on the schematic figures shown in FIGS. 23A to 23G.

The driving motor 304 of the elevating mechanism 302 shown in FIG. 22 is firstly driven to bring down the common substrate 300 by rotation of the eccentric cam 306. The driving motor 318 of the moving mechanism 312 is driven to raise the slider 314 and the common substrate 310 supported by the slider 314. Accordingly, the six cap members 80 attached to the common substrate 300 descend from the home position (i.e., moving in the direction of leaving from the recording head 40), and the six wiping member 88 attached to the common substrate 310 rise from the home position (i.e., moving in the direction of approaching the nozzle surface 40A of the recording head 40), as shown in FIGS. 23A and 23B.

In this example, the cap member 80 descends to the position at 6 mm from the nozzle surface 40A of the unit recording head 40, and the tip end (upper end) of the wiper 92 of the wiping member 88 rises to the position higher than the nozzle surface 40A by 1.5 mm (hereinafter, referred to as a contact amount of 1.5 mm).

As a result, the retaining member 90 of the wiping member 88 becomes movable by overstriding the cap member 80 in the width direction. The wiper 92 of the wiping member 88 is in such a state that it overlaps the nozzle surface 40A of the recording head 40 in the vertical direction (the direction shown by the arrow Z in FIGS. 23A to 23G) as shown in FIG. 23B.

In this state, the driving motor 316 of the moving mechanism 312 shown in FIG. 22 is driven to move the common substrate 310 in the width direction on the slider 314 through the rack 322 engaged with the driving gear 326. Accordingly, the wiping member 88 attached to the common substrate 310 is moved in the width direction, whereby the wiper 92 of the wiping member 88, the tip end of which is at a position higher than the nozzle surface 40A, is moved with slidably contacting with the nozzle surface 40A of the unit recording head 40. As a result, dusts and a dried ink attached to the nozzle surface 40A are removed as shown in FIG. 23C. At this time, the wiping member 88 is moved by overstriding the cap member 88 thus having descended.

In this example, the wiper 92 is in slidably contact with the nozzle surface 40A with maintaining the contact amount of 1.5 mm, whereby contamination attached to the nozzle surface 40A is certainly removed.

The wiping member 88 then escapes from the area under the nozzle surface 40A to complete the movement of the wiping member 88 and the guide member 94 in the width direction as shown in FIG. 23D. Subsequently, the common substrate 310, i.e., the wiping member 88, is brought down by driving the driving motor 318 of the moving mechanism 312 to move to the height of the home position as shown in FIG. 23E.

The common substrate 310, i.e., the wiping member 88, is then moved to the opposite side in the width direction by driving the driving motor 318 of the moving mechanism 312 shown in FIG. 20 to make it revert to the home position as shown in FIG. 23F. Furthermore, the cap member 80 is raised by driving the driving motor 304 of the elevating mechanism 302 to make it revert to the home position near the nozzle surface 40A of the recording head 40, whereby the wiping operation is completed as shown in FIG. 23G.

Subsequently, the capping operation will be described.

Figure 26A:
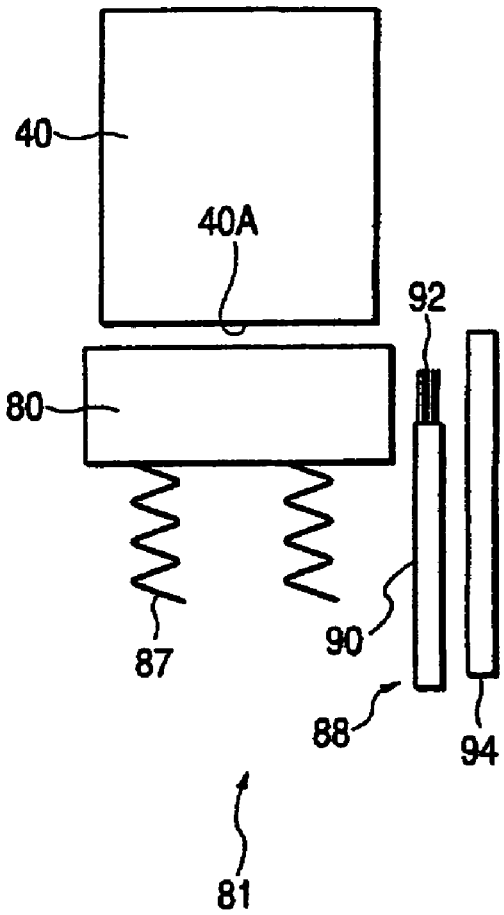
FIGS. 26A and 26B are operational explanatory views showing capping operation in a recording apparatus according to Example 1 of the invention.
Figure 26B:
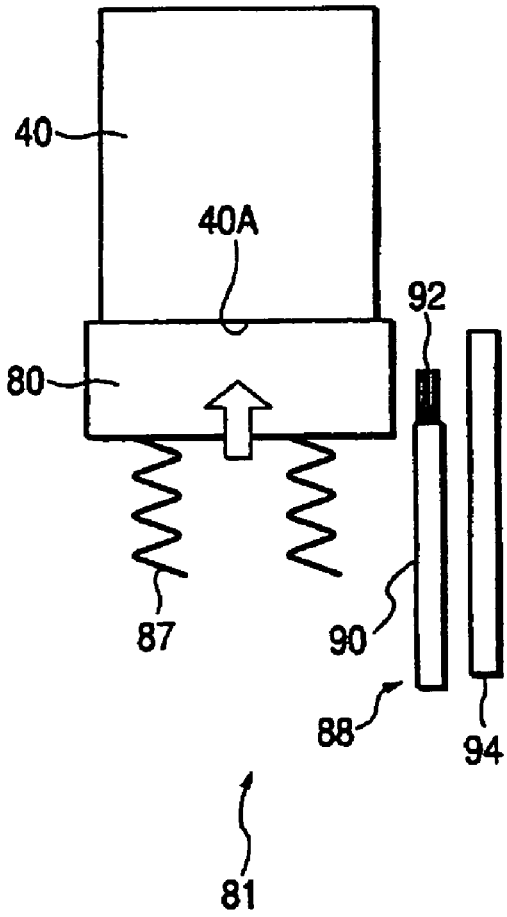

The capping operation is carried out in the case where the non-printing state continues for a long period of time, or in the case where the power of the apparatus is turned off. Specifically, the driving motor 304 of the elevating mechanism 302 shown in FIG. 22 is driven to raise the common substrate 300 to press the rubber member 84 of the cap member 80 attached to the common substrate 300 onto the nozzle surface 40A of the recording head 40 as shown in FIGS. 26A and 26B. As a result, the airtightness of the nozzle surface 40A (i.e., the nozzles 58) is ensured, whereby increased viscosity and drying of the ink are prevented, and attachment of dusts is also prevented.

As shown in FIG. 16, the recording head 44 in this example is constituted by attaching the recording head arrays 42A and 42B formed by arranging plural short unit recording heads 40 to the common substrates 46A and 46B, respectively, whereby the production thereof can be standardized as with inexpensive devices (recording heads), which are mass-produced, and the recording head 40 capable of printing on the entire width can be produced at low cost.

Furthermore, the recording head arrays 42A and 42B are attached to the common substrates 46A and 46B, respectively, whereby the constitutions of the recording head arrays 42A and 42B are simplified, and thus the production and the adjustment in high accuracy thereof can be conveniently carried out. Furthermore, there is such an advantage that the constitution of the maintenance part (including the cap member 80 and the wiping member 88) can be standardized as with those used in a recording head of a short length. Moreover, there is also such an advantage that a unit for making constant the distance between the nozzle surface 40A and the paper (e.g., the star wheel 70 in this example) can be disposed by utilizing the gap (space) among the unit recording heads in the width direction, or the degree of freedom in designing the arrangement of the cap member 80 can be increased by that gap (space).

While one cap member 80 is provided as corresponding to one unit recording head 40 in this example, only one cap member 80 may be provided as corresponding to plural unit recording heads 40.

EXAMPLE 2

An ink-jet recording apparatus according to Example 2 of the invention will be described. The same constitutional elements as in the aforementioned embodiment and Example 1 are attached with the same symbols, and detailed descriptions thereof are omitted herein. The description will be made by focusing on the differences from Example 1.

Figure 27A:
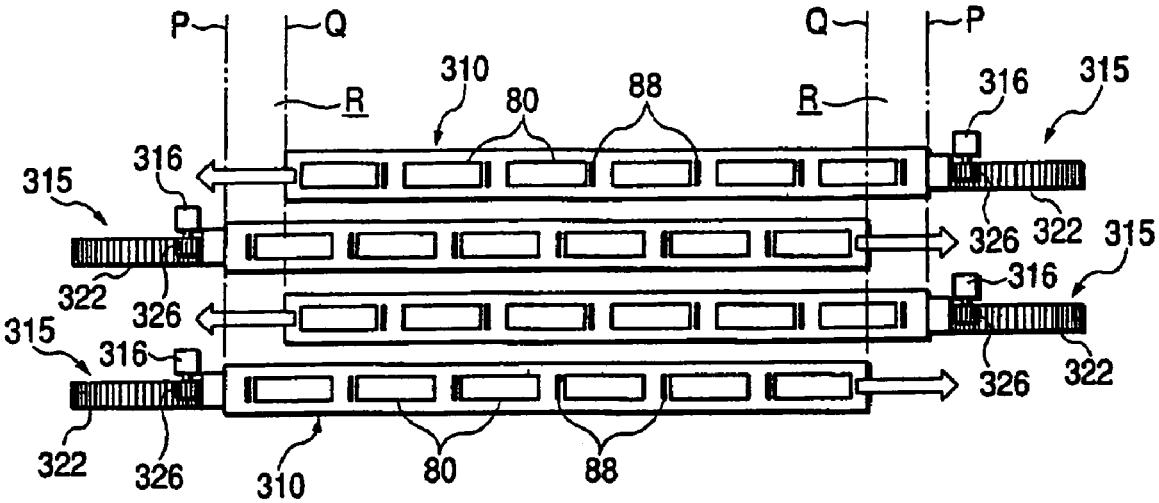
FIGS. 27A and 27B are operational explanatory views of a moving mechanism of a recording apparatus according to Examples 1 and 2 of the invention.
Figure 27B:
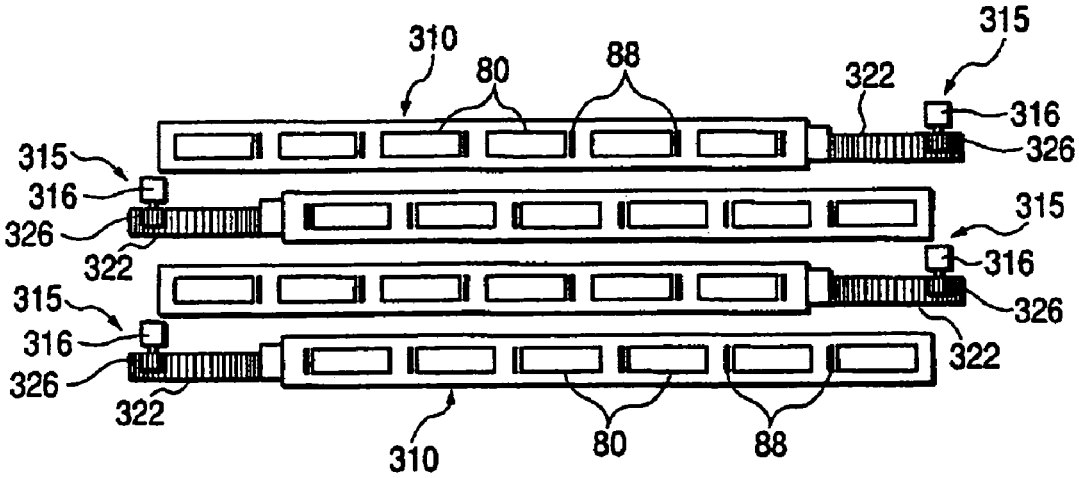

In the maintenance part (including the cap members 80 and the wiping members 88) shown in FIGS. 25, 27A and 27B, the unit recording heads 40 are arranged in a staggered form to form spaces R with the casing 102, toward which the common substrates 310 are moved, and also sliding mechanisms 315 disposed at the ends of the common substrates 310 are opposite to each other between the adjacent common substrates 310.

Figure 29:
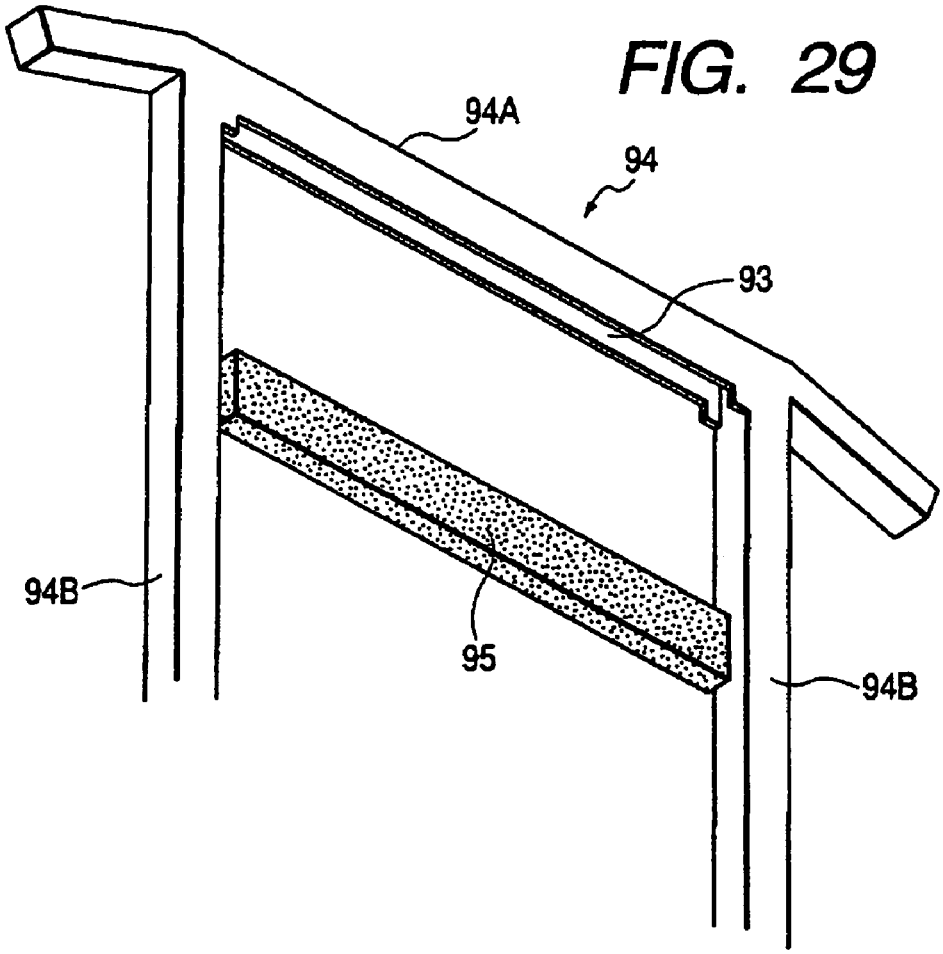
FIG. 29 is a disassembled view showing a constitution of a removing member according to Example 2 of the invention.
Figure 30:
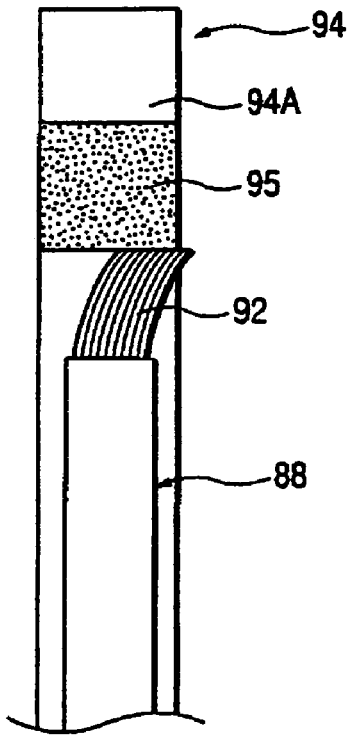
FIG. 30 is an explanatory view showing a state where a wiping member is cleaned according to Example 2 of the invention.

As shown in FIG. 21, in the guide members 94 disposed on both sides in the width direction of the cap member 80, an ink absorbent 95 is provided on the lower surface of the horizontal part 94A constituting the guide member 94 and extending in the conveying direction of the paper. As shown in FIG. 29, a depressed housing part 93 having a substantially horseshoe cross section is provided on the lower surface of the horizontal part 94A of the guide member 94, and the ink absorbent 95 having a substantially rectangular shape is detachably inserted in the housing part 93. As shown in FIG. 30, the wiping member 88 passes under the guide member 94, whereby the wiper 92 of the wiping member 88 is in slidably contact with the ink absorbent 95 (which is described later).

Examples of a material of the ink absorbent 95 include, as similar to the ink absorbent 86 (shown in FIG. 21), a polyester felt fibrous material and an acrylonitrile felt fibrous material, and a mixture of a polyester felt fibrous material and an acrylonitrile felt fibrous material can also be preferably used. The ink holding capability of the ink absorbent 95 can be finely adjusted by changing the fiber diameter, the fiber length and the arranging direction of the fibrous material used.

Examples thereof also include a polyamide fibrous material, a polypropylene fibrous material, a polyvinyl alcohol fibrous material, a polyvinylidene chloride fibrous material and a polyurethane fibrous material.

A polyester fibrous material is preferably used from the standpoint of absorbance of a recording liquid, such as an ink, and a mixed system of these materials may also be preferably used.

Figure 28A:
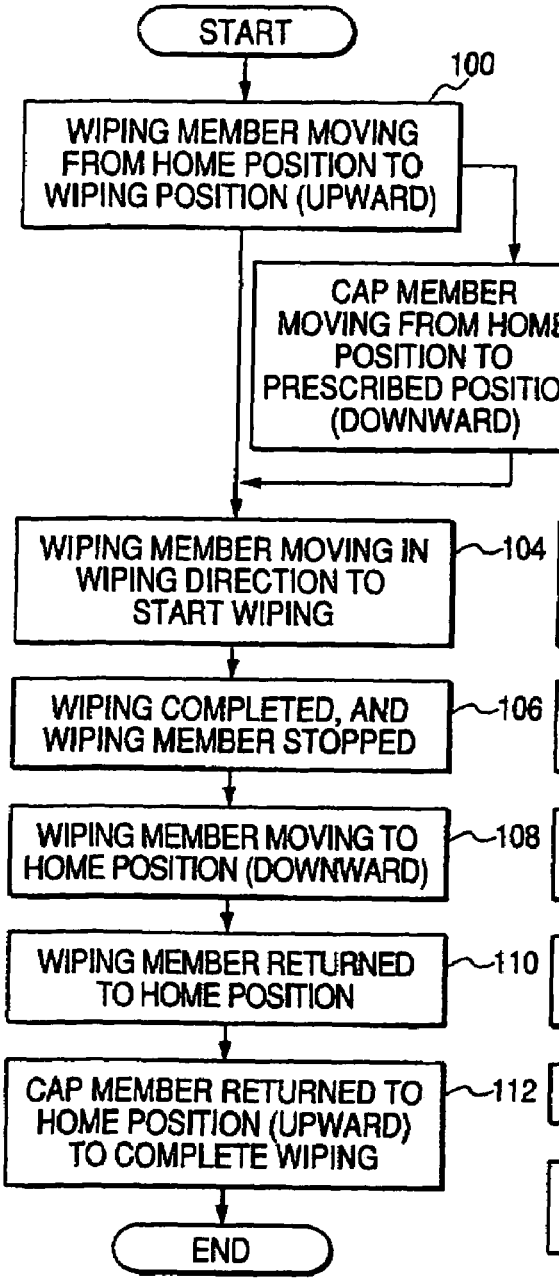
FIG. 28A is a flow chart showing operation of a maintenance part according to Example 1 of the invention.
Figure 28B:
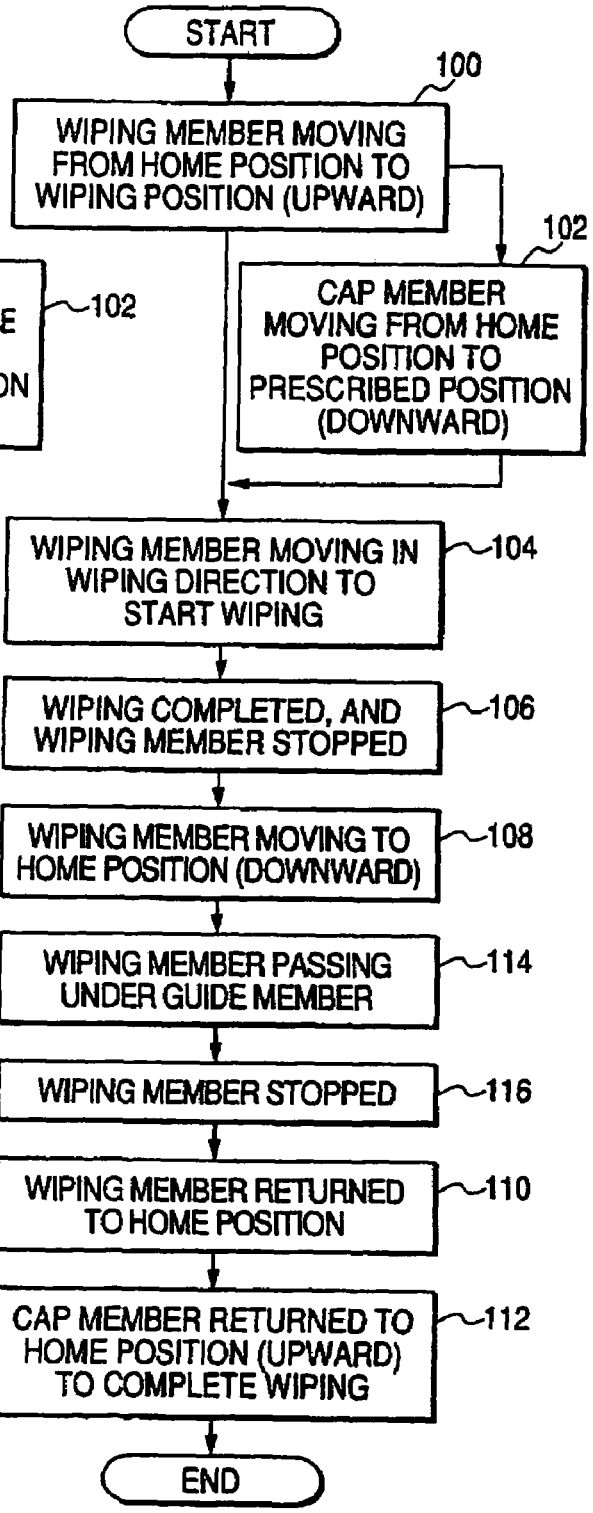
FIG. 28B is a flow chart showing operation of a maintenance part according to Example 2 of the invention.

The operation of the wiping member 88 in this example will be described with reference to FIGS. 22 and 28B. Descriptions for the overlap with Example 1 will be simplified.

As shown in FIGS. 23A and 23B, the wiping member 88 rises from the home position (step 100), and the cap member 80 descends from the home position (i.e., moves in a direction leaving from the unit recording head 40) (step 102). As shown in FIG. 23C, the wiper 92 of the wiping member 88 is in slidably contact with the nozzle surface 40A of the unit recording head 40 to start wiping (step 104).

As shown in FIG. 23D, the wiping member 88 completes the movement in the width direction to stop movement of the wiping member 88 (step 106), and then as shown in FIG. 23E, the wiping member 88 descends to move the height of the home position (step 108).

In this example, thereafter, the common substrate 310 is moved on the slider 314 in the width direction (the same direction as the cleaning direction of the nozzle surface 40A) by driving the driving motor 316 of the moving mechanism 312 driven through the rack 322 engaged with the driving gear 326.

According to the operation, as shown in FIG. 23F, the wiping member 88 passes under the guide member 94 (step 114) to make the wiper 92 of the wiping member 88 in slidably contact with the ink absorbent 95, followed by stopping the movement of the wiping member 88 (step 116).

After reverting the wiping member 88 to the home position (step 110) as shown in FIG. 23H, the cap member 80 rises to be reverted to the home and completes the wiping operation position as shown in FIG. 23I (step 112).

According to the operation, the wiping member 88 moves from the home position, cleans the nozzle surface 40A of the unit recording head 40, leaves from the recording head 40, descends downward to leave from the unit recording head 40, and then passes under the guide member 94 disposed on the moving path of the wiping member 88 (in the same direction as the cleaning direction of the nozzle surface 40A) to be slidably in contact with the ink absorbent 95 of the guide member 94, and the wiping member 88 then moved to the opposite side to go back to the home position.

The function of the ink-jet recording apparatus 10 thus constituted as described in the foregoing will be described.

At the end of the common substrate 310 shown in FIG. 22, it is necessary to ensure a space for disposing the sliding mechanism 315. In the case where the sliding mechanisms 315 for all the common substrates 310 are disposed on the same side, it is necessary that at least the adjacent sliding mechanisms 315 are prevented from interfering with each other to impair space saving.

However, in the case where the sliding mechanisms 315 of the common substrates 310 are disposed opposite to each other between the adjacent common substrates 310 as shown in FIG. 27A, the sliding mechanisms 315 can be prevented from interfering with each other since the sliding mechanisms 315 are not adjacent to each other. Therefore, the distance between the adjacent common substrates 310 can be reduced to attain space saving.

The unit recording heads 40 are, arranged in a staggered form (i.e., the cap members 80 arranged to face the unit recording heads 40 are also arranged in a staggered form) to form spaces R with casing 102 (as shown in FIG. 25), toward which the common substrates 310 are moved, whereby the spaces R can be effectively used.

As shown in FIG. 21, the ink absorbent 95 is provided in the guide member 94 to make the wiper 92 of the wiping member 88 in slidably contact with the ink absorbent 95, whereby the ink attached to the wiper 92 can be removed. In the case where the ink remains attached to the wiper 92, the ink is accumulated thereon to impair the cleaning function of the wiper 92. Therefore, the removal of the ink attached to the wiper 92 not only maintains the cleaning function of the wiper 92 but also prolongs the service life of the wiper 92.

Upon continuously recovering the ink by the ink absorbent 95 from the wiper 92, the ink penetrates into the interior of the ink absorbent 95 to lower the ink absorbing function gradually. However, the ink absorbent 95 can be appropriately replaced since the ink absorbent 95 is detachably inserted in the guide member 94.

Because the guide member 94 is positioned on the same straight line as the cap member 80 and the wiping member 88, by imposing the ink absorbent 95 on the guide member 94 the ink absorbent 95 removing contamination of the wiping member 88 is thus disposed on the moving path of the wiping member 88. According to the configuration, there is no necessity to equip the wiping member 88 with another ink suction device or the like for removing the contamination of the wiping member 88, whereby the ink absorbent 95 can function through the wiping operation to simplify the mechanism.

EXAMPLE 3

An ink-jet recording apparatus according to Example 3 of the invention will be described. The same constitutional elements as in the aforementioned embodiment and Examples 1 and 2 are attached with the same symbols, and detailed descriptions thereof are omitted herein. The description will be made by focusing on the differences from. Examples 1 and 2.

Figure 31:
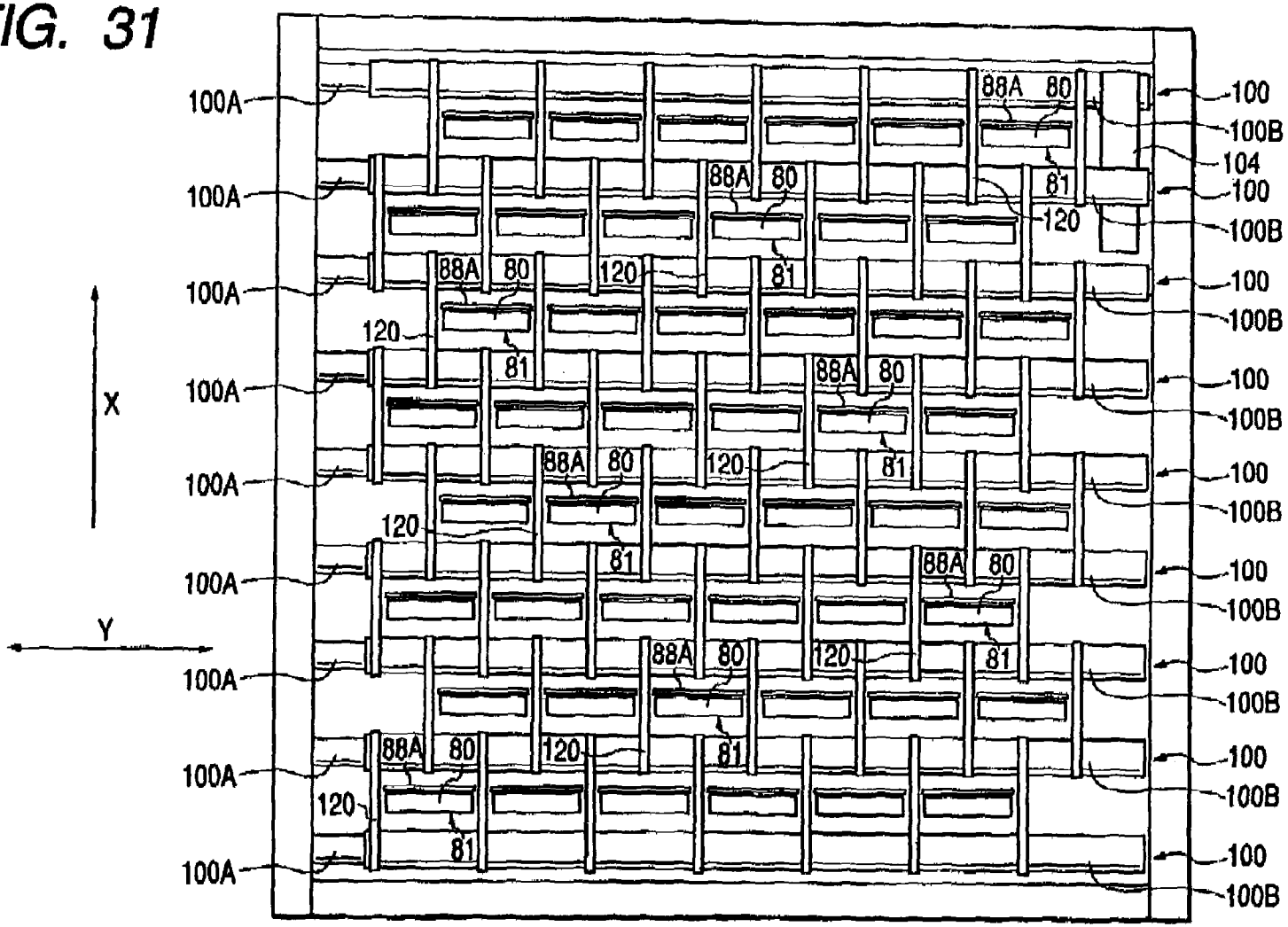
FIG. 31 is a schematic plane view showing a maintenance part according to Example 2 of the invention.

In the maintenance device 81, as shown in FIG. 31, thin belts 120 are stretched between the adjacent conveying rolls 100 for ensuring the planarity at the printing position, instead of the guide members 94 in Examples 1 and 2. That is, the thin belt 120 is stretched between the unit recording heads 40, between which the guide member 94 and the wiping member 88 have been disposed in Examples 1 and 2.

Star wheels 70 are disposed opposite position as similar to Examples 1 and 2 (as shown in FIG. 32). In this example, the thin belt 120 is a polyurethane belt having a width of 5 mm and a thickness of 2 mm.

The wiping member 88A is disposed on the downstream side in the paper conveying direction with respect to the cap member 80. As shown in FIG. 32, in the transmission of the driving force to the conveying roll 100, the driving force is transmitted by a flat belt 104 stretched between the driving shaft 108 of the DC motor 106 and the large diameter part 100B of the conveying roll 100 on the most downstream side in the conveying direction, and then transmitted to the other conveying rolls 100 through the thin belt 120 stretched on the large diameter parts 100B of the conveying rolls 100. As a result, all the conveying rolls 100 are driven at the same velocity.

Figure 33:
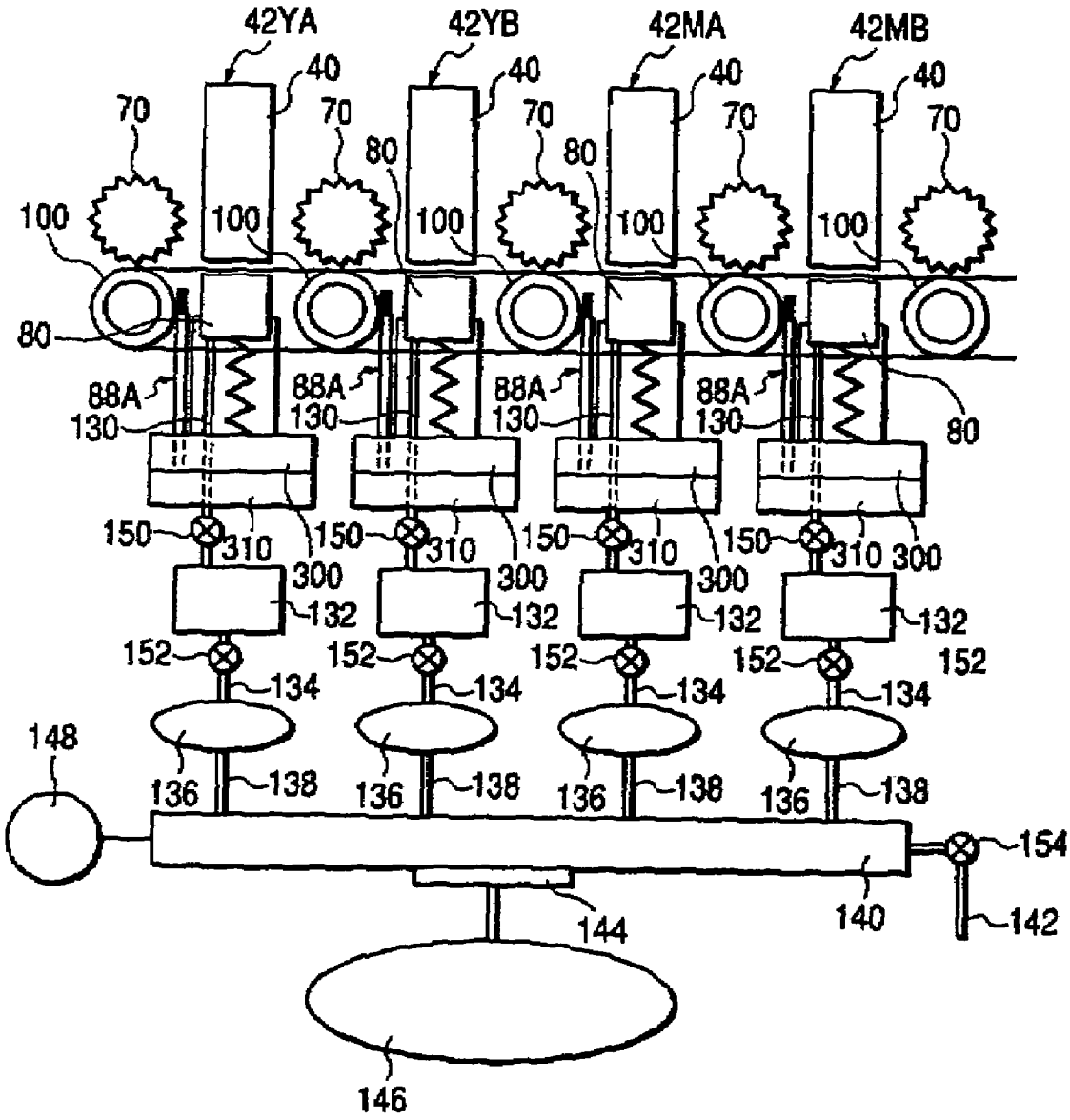
FIG. 33 is an explanatory view showing a waste ink recovering mechanism of a recording apparatus according to Example 2 of the invention.
Figure 34:
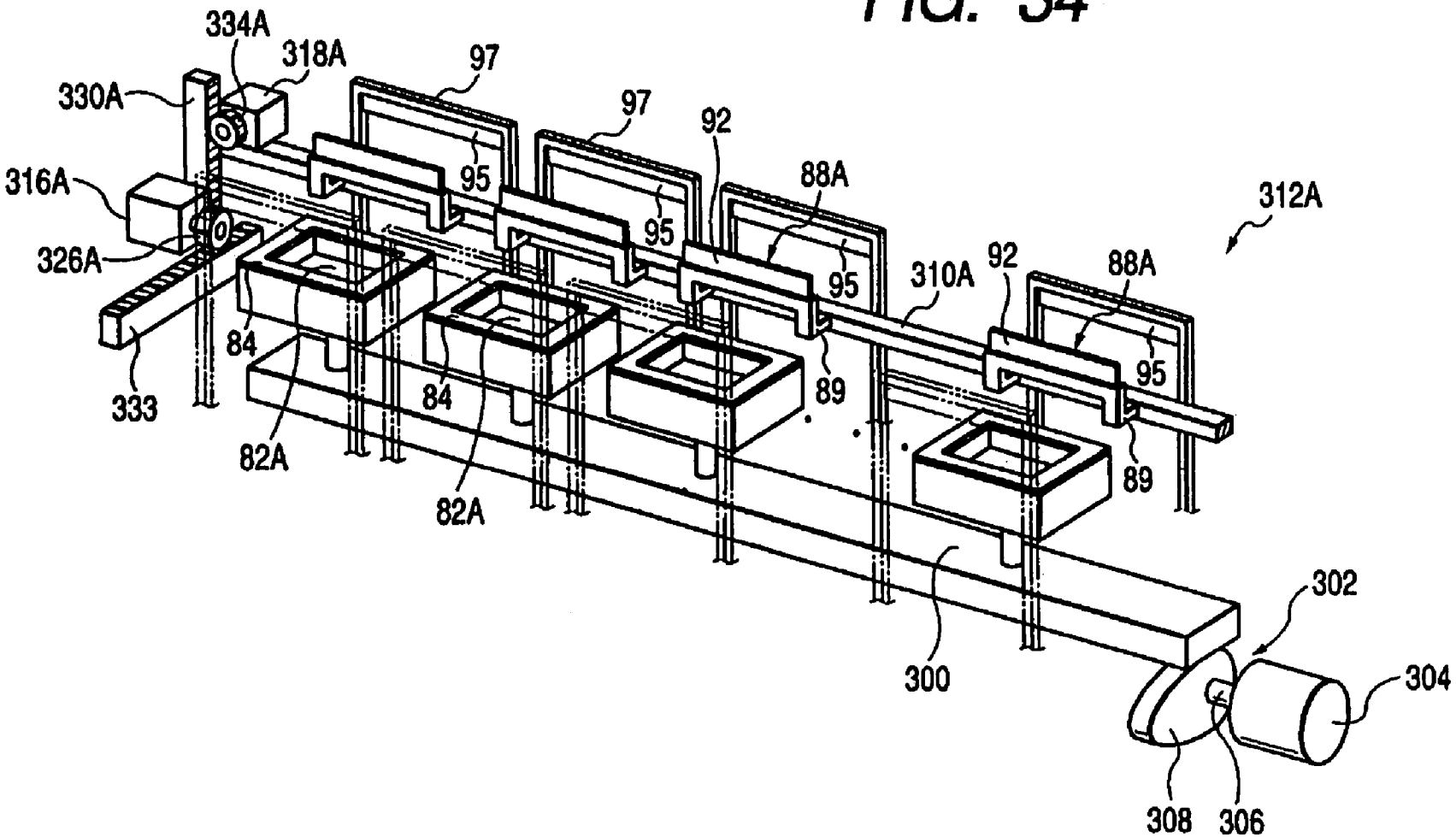
FIG. 34 is an explanatory view showing an elevation mechanism and sliding mechanism of the maintenance mechanism of example 3.

The cap members 80 and the wiping members 88A in this example are disposed as shown in FIGS. 31, 33 and 34, i.e., six cap members 80 and six wiping members 88A arranged in one line in the width direction are attached to the common substrates 300 and 310A, respectively, and the moving mechanism 312A has basically the same constitution as the moving mechanism 312 shown in FIG. 22.

However, in order that the wiping member 88A moves in the conveying direction of the paper, a stem 89 of the wiping member 88A is formed to have a substantially L-shape, whereby the common substrate 310A moves above the cap members 80A in the conveying direction of the paper.

That is, a driving motor 318A is attached to one end of the common substrate 310A, and a driving gear 334A directly connected thereto is engaged with a rack 330A set up on the side of the casing 102 (shown in FIG. 31). Consequently, the common substrate 310A can be elevated.

A rack 33 is disposed on the casing 102 perpendicular to the rack 330A. A driving motor 316A is attached to the rack 330A, and a driving gear 326A directly connected to the driving motor 316A is engaged with the rack 333, whereby the common substrate 310A is movable in the conveying direction of the paper.

As shown in FIG. 31, a retaining member 97 retaining the ink absorbent 95 (shown in FIG. 29) moves with the moving path of the wiping member 88A to the side of the cap member 80 opposite to the wiping member 88A.

Since the retaining member 97 is disposed in a direction perpendicular to the conveying direction of the paper, the height of the retaining member 97 is set at a level lower than the conveying path for conveying the paper to prevent it from impairing the convey of the paper, and there is no necessity to provide a guide part for guiding the paper on both ends of the horizontal part of the retaining member 97.

In this example, a unit for sucking an ink from the concave part 82A of the receiving part 82 of the cap member 80 through a hole provided in the ink absorbent 86, as shown in FIG. 21, and as shown in FIG. 33, a first waste ink recovering tank 132 (having a capacity of 4 cc) connected to the concave part 82A of the receiving part 82 of each of the cap members 80 through a flow path 130 is provided under the respective cap member 80.

Furthermore, a second waste ink recovering tank 136 (having a capacity of 60 cc) connected to six first waste ink recovering tanks, 132 corresponding to six cap members 80 arranged in the straight form in the width direction through flow paths 134 is provided.

Furthermore, a third waste ink recovering tank 140 connected to eight second waste ink recovering tanks 136 through flow paths 138 is provided. The third waste ink recovering tank 140 can discharge the waste ink to the exterior through a flow path 142 and is connected to a vacuum pump 146 through a filter 144. The third waste ink recovering tank 140 can be measured for negative pressure with a negative pressure measuring device 148.

A first electromagnetic switching valve 150, a second electromagnetic switching valve 152 and a third electromagnetic switching valve 154 are provided on the flow paths 130, 134 and 142, respectively, and can be selectively switched.

Accordingly, the waste ink accumulated in the cap member 80 (concave part 82A) is recovered by driving the vacuum pump 146 and switching the electromagnetic switching valves 150, 152 and 154, or the ink on the nozzle surface 40A or inside the nozzles 58 can be sucked with the vacuum operation described later.

The function of the ink-jet recording apparatus 10 thus constituted will be described. The descriptions for the similar operation as in Examples 1 and 2 are omitted herein, and only the vacuum operation will be described.

Figure 35A:
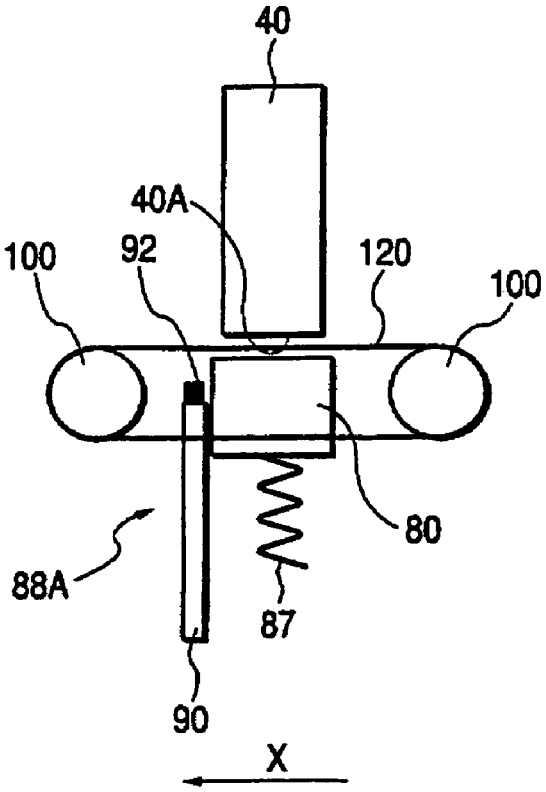
FIGS. 35A and 35B are explanatory views showing a home position of a cap member according to Example 2 of the invention.
Figure 35B:
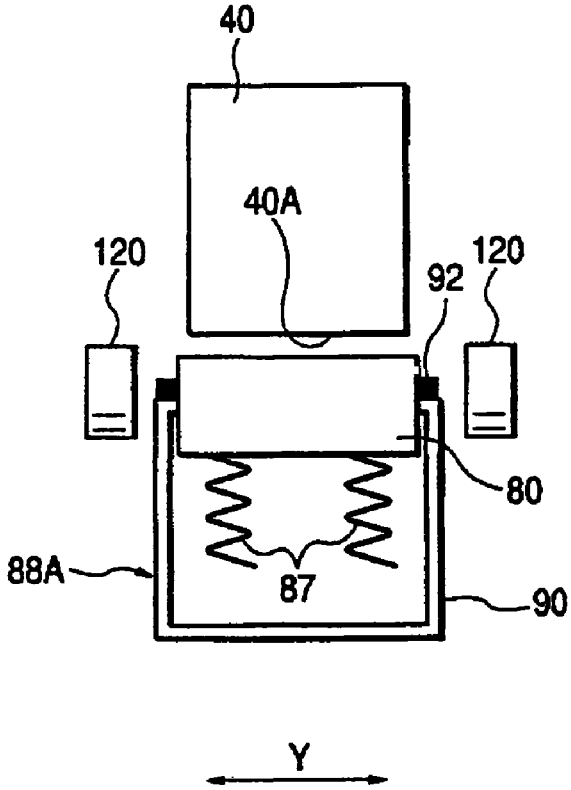
Figure 36A:
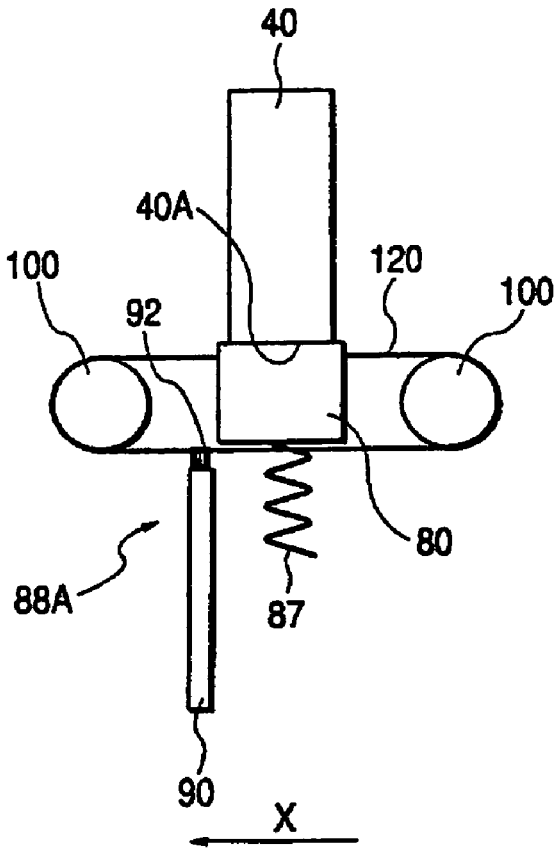
FIGS. 36A and 36B are explanatory views showing a cap position of a cap member according to Example 2 of the invention.
Figure 36B:
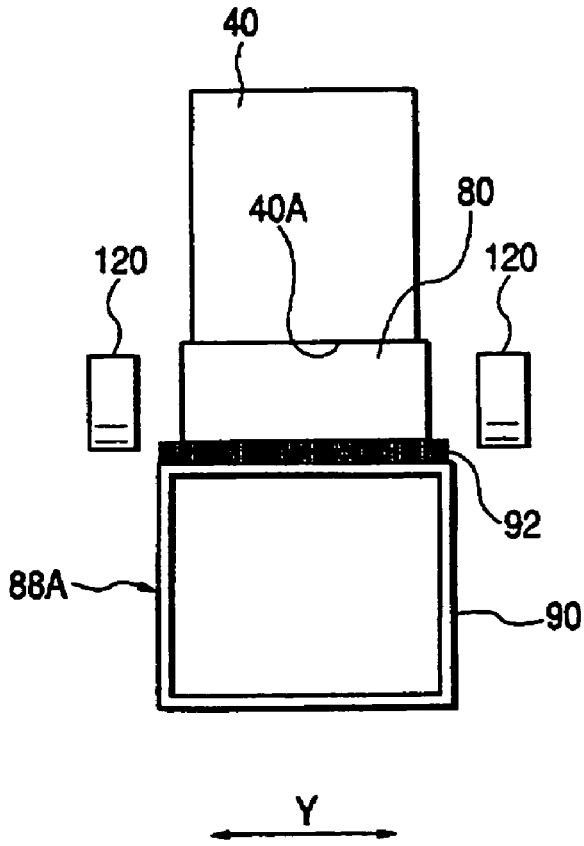
Figure 37A:
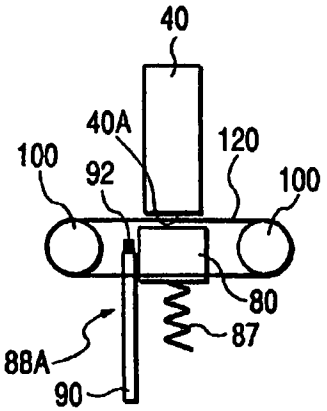
FIGS. 37A to 37G are operational explanatory views showing wiping operation in a recording apparatus according to Example 2 of the invention.
Figure 37B:
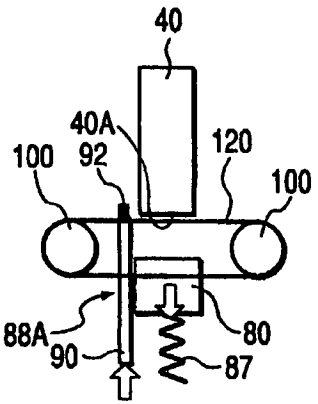
Figure 37C:
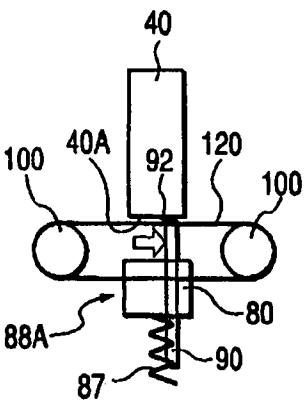
Figure 37D:
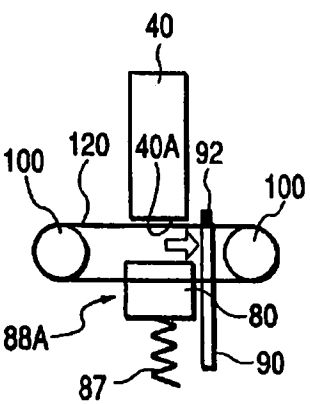
Figure 37E:
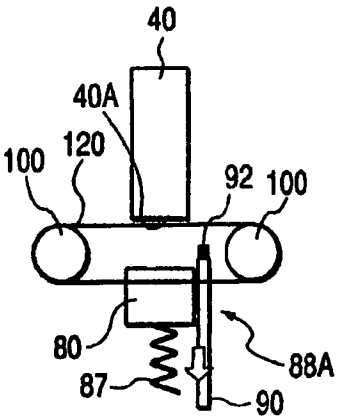
Figure 37F:
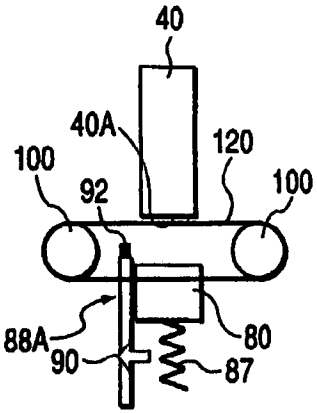
Figure 37G:
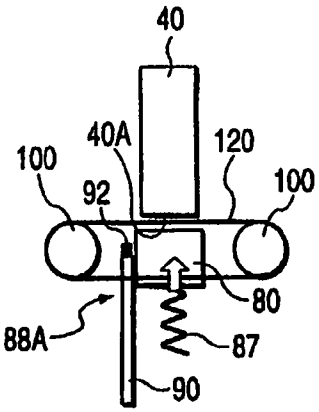
Figure 37G:
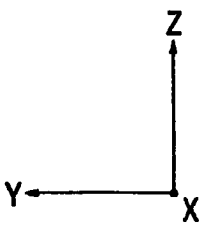

As shown in FIGS. 35A, 35B, 36A and 36B (in which FIGS. 35A and 36A are side views, and FIGS. 35B and 36B are elevational views), the cap member 80 at the home position is raised by driving the elevating unit 302 (shown in FIG. 34) to be pressed onto the nozzle surface 40A of the unit recording head 40. As a result, the receiving part 82 of the cap member 80 covers and seals the nozzle surface 40A airtightly.

A negative pressure is supplied to the cap member 80 in this state. Specifically, the following operation is carried out.

The first electromagnetic switching valves 150 provided on the flow paths 130 and the third electromagnetic switching valve 154 provided on the flow path 142 are closed as shown in FIG. 33. The vacuum pump 146 is driven until the measured pressure with the negative pressure measuring device 148 reaches the prescribed value. At the time when the measured pressure reaches −70 kPa with respect to the atmospheric pressure, the driving of the vacuum pump 146 is terminated. According to the operation, a prescribed negative pressure is applied to the first to third waste ink recovering tanks 132, 136 and 140. The second electromagnetic switching valves 152 are then closed.

At this time, the first electromagnetic switching valve 150 is released that is provided on the flow path 130 connected to the first waste ink recovering tank 132 corresponding to the cap member 80 or the unit recording head 40, in which the ink is to be recovered. According to the operation, the concave part 82A of the cap member 80 (shown in FIG. 34) is connected to the first waste ink recovering tank 132 applied with a negative pressure, whereby the ink accumulated in the concave part 82A of the receiving member 82, the ink and dusts attached to the nozzle surface 40 having been sealed airtightly with the rubber part 84, and the ink having an increased viscosity present inside the nozzles 58 are sucked with the negative pressure to be recovered in the first waste ink recovering tank 132.

Subsequently, the cap member 80 is brought down by driving the elevating mechanism 302 (shown in FIG. 34) to make it revert to the home position (i.e., leaving from the nozzle surface 40A), and all the first electromagnetic switching valves 150 and the second electromagnetic switching valves 152 are closed, so as to recover the waste ink in the cap member 80, the first waste ink recovering tanks 132 and the second waste ink recovering tanks 136 to the third waste ink recovering tank 140 applied with a negative pressure.

Accordingly, the ink (waste ink) accumulated in the concave part 82A of the cap member 80 can be recovered by applying a negative pressure to the concave part 82A of the recording head 80, and bubbles and the ink having an increased viscosity in the nozzles 58 can be removed by sucking the ink from the nozzles 58 (shown in FIG. 16).

The wiping operation in this example is the same as in Examples 1 and 2 except for the wiping direction, which is in the conveying direction in this example. Therefore, figures for describing the operation are shown in FIGS. 37A to 37I, in which the specific procedures of the operation are the same as in FIGS. 23A to 23I, but detailed descriptions are omitted herein.

On the other hand, as shown in FIG. 32, the motor 106 is driven in the recording part 20, whereby the driving force is transmitted to the conveying roll 100 on the most downstream side through the flat belt 104. Among the conveying rolls 100 adjacent to each other, the thin belt 120 is stretched, whereby the conveying rolls 100 are driven at the same velocity.

As shown in FIG. 18, the star wheels 70 of the group of star wheels 72 are biased onto the side of the conveying rolls 100 with the springs 75, whereby the paper thus conveyed is made into contact with the conveying rolls 100 by pressing with the star wheels 70 and is conveyed at a constant velocity by transmitting the prescribed driving force from the conveying rolls 100.

As shown in FIG. 33, the driving force is transmitted among the conveying rolls 100 through the thin belt 120, whereby the paper is certainly conveyed at a constant velocity, and the planarity of the paper at the printing position is ensured.

In this example, six cap members 80 and six wiping members 88A arranged in the width direction are attached to the common substrates 300 and 310A (shown in FIG. 34), respectively, which can be integrally moved, so as to provide such an advantage that the driving mechanism can be simplified. This example also exerts the similar effects as in Examples 1 and 2.

The vacuum operation and the mechanisms therefor described in this example may be applied to Examples 1 and 2.

EXAMPLE 4

An ink-jet recording apparatus according to Example 4 of the invention will be described. The same constitutional elements as in Examples 1, 2 and 3 are attached with the same symbols, and detailed descriptions thereof are omitted herein. The description will be made by focusing on the differences from Examples 1, 2 and 3.

Figure 38:
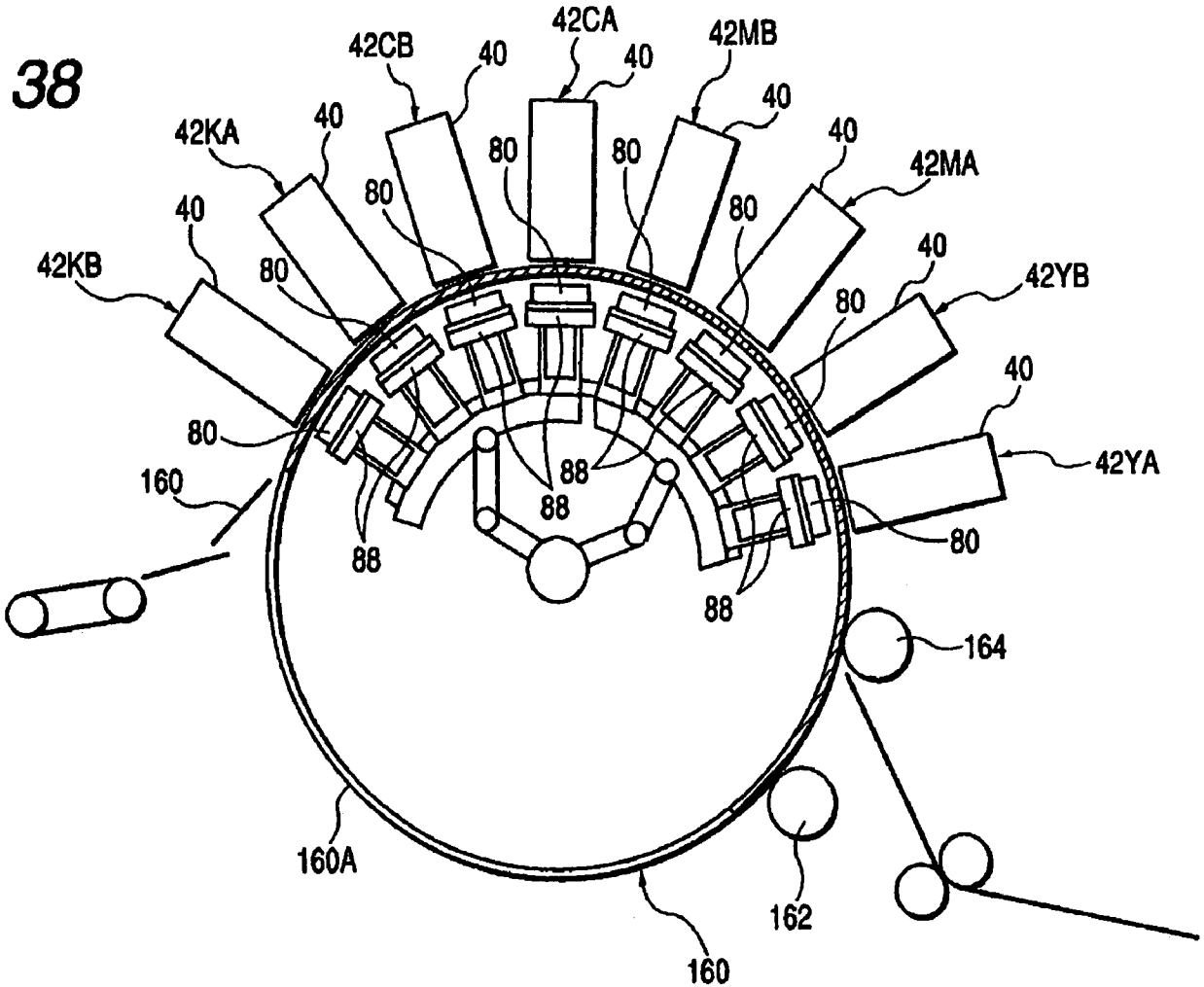
FIG. 38 is a schematic explanatory view showing a recording part of a recording apparatus according to Example 3 of the invention.

The ink-jet recording apparatus 400 according to this example uses, as one of significant characteristics, an electrostatic sorption drum (hereinafter, sometimes simply referred to as a drum) 160 is used as a conveying system as shown in FIG. 38.

The drum 160 has a semiconductive or insulating sheet provided on a paper retaining area on the outer peripheral surface thereof, which is charged with a charging roll 162 disposed on the upstream side in the conveying direction, and paper is electrostatically adsorbed on the drum 160 by pressing onto the drum 160 with a pressing roll 164, and is rotationally conveyed associated with the drum 160 by the rotation of the drum 160, followed by being released from the outer peripheral surface of the drum with a releasing unit 166 disposed on the downstream side in the conveying direction.

An opening 160A is provided at a position different from the paper retaining area on the outer peripheral surface of the drum 160 and is used upon the maintenance operation (including dummy jet, wiping, capping and vacuum operations).

Eight recording head arrays 42YA to 42KB constituting recording heads 44Y to 44K of four colors are arranged along the rotational direction on the outer peripheral surface of the drum 160. The constitutions of the respective recording head arrays 42 are the same as in Examples 1 to 3.

Cap members 80 are disposed inside the drum 160 at positions opposite to the unit recording heads 40, and wiping members 88 are disposed at position adjacent in the width direction to the cap members 80. The arrangements thereof are the same as in Examples 1 and 2.

Six cap members 80 and six wiping members 88 arranged in the width direction are attached to the same common substrates 404 and 410, as similar to Examples 1 and 2, and can be integrally moved with the elevating mechanism 402 and the moving mechanism 415.

The function of the ink-jet recording apparatus 400 thus constituted will be described.

Upon printing, the paper retaining area of the drum 160 is charged with the charging drum 162, and the paper pressed to the outer peripheral surface of the drum 160 with the pressing roll 164 is electrostatically adsorbed on the outer peripheral surface of the drum 160 and is conveyed by rotating associated with the drum 160.

Ink droplets are ejected to the paper from the nozzles 58 of the unit recording heads 40 constituting the respective recording head arrays 42YA to 42KB to attain color printing. The paper having been printed in color is released from the outer peripheral surface of the drum 160 with the releasing unit 166.

The paper is conveyed by electrostatically adsorbed on the paper retaining area on the drum 160, whereby the distance between the nozzle surfaces 40A of the respective unit recording heads 40 and the paper can be maintained at a constant value to attain full color printing with high image quality.

Upon carrying out the dummy jet operation, on the other hand, ink droplets are ejected from the nozzles 58 to the cap members 80 (i.e., dummy jet is carried out) at a time when the opening 160A reaches the position opposite to the unit recording head 40 after the passage of the paper retaining area on the drum 160. According to the operation, the printing performance can be initialized.

Upon carrying out the capping, vacuum and wiping operations, the rotation of the drum 160 is terminated at a position where the opening 160A is opposite to all the unit recording heads 40, and the capping, vacuum and wiping operations are then carried out with the elevating mechanism 402 and the moving mechanism 415 in the same manner as in Examples 1 and 2.

In particular, there is no necessity of moving the recording heads 44Y to 44K for carrying out the maintenance operation, whereby misalignment of the printing position due to movement of the recording heads 44Y to 44K causing deviation in printing is prevented from occurring to attain printing with high image quality. There is also such an advantage that no mechanism is necessary for moving the recording heads 44Y to 44K, so as to simplify the mechanism.

In the recording apparatus of the invention, the term "recording medium" as a target of image recording encompasses wide variety of materials, to which ink droplets are ejected from the recording apparatus. Patterns formed with dots on the recording medium obtained by attaching ink droplets to the recording medium are included in the "image" and the "recorded image" obtained with the recording apparatus of the invention. Therefore, the recording apparatus of the invention is not limited to those used for recording characters and images on recording paper.

The recording medium includes not only recording paper and an OHP sheet, but also, for example, a substrate, on which a wiring pattern is to be formed. The "image" includes a general image (including characters, pictures and photographs) and also the aforementioned wiring pattern, a three-dimensional object, an organic thin film and the like. The liquid thus ejected is not limited to a coloring ink.

For example, the recording apparatus of the invention can be applied to general liquid droplet ejecting apparatuses for various kinds of industrial purposes, such as production of a color filter for a display attained by ejecting a coloring ink on a polymer film or glass, production of bumps for mounting electronic parts on a substrate attained by ejecting molten solder on the substrate, production of an EL display panel attained by ejecting an organic EL solution on a substrate, and production of bumps for electric implementation attained by ejecting molten solder on a substrate.

The effect of the recording apparatus according to the invention will be described.

The recording medium is conveyed between the recording head and the maintenance device by the conveying unit, whereby a liquid droplet is ejected from the recording head to the recording medium to effect printing on the recording medium. Because the maintenance device is disposed at a position opposite to the liquid droplet ejecting surface of the recording head, there is no necessity of moving the recording head for carrying out the maintenance operation, and thus the maintenance operation can be effectively carried out. For example, dummy jet can be effected by ejecting a liquid droplet from the recording head to the liquid housing unit within a period between passage of a preceding recording medium and arrival of a subsequent recording medium. Furthermore, the liquid droplet ejecting surface of the recording head can be cleaned by operating the cleaning unit, whereby the liquid droplet ejection performance can be well maintained.

Moreover, because there is no necessity of moving the recoding head for carrying out the maintenance operation, fluctuation of printing quality due to misalignment in the maintenance operation does not occur to maintain the printing quality constantly. The constitution of the apparatus can also be simplified owing to the non necessity of the mechanism for moving the recording head for maintenance.

Accordingly, printing with high image quality can be carried out with high productivity while maintaining the good liquid droplet ejection performance of the recording head. Further, the maintenance operation can be carried out with a relatively simplified constitution.

The entire disclosure of Japanese Patent Application No. 2003-295649 filed on Aug. 19, 2003 including specification, claims, drawings and abstract is incorporated herein by reference in its entirety.

What is claimed is:

1. A recording apparatus comprising:

a recording head having a liquid droplet ejecting surface, the recording head ejecting a liquid droplet to a recording medium;

a maintenance device disposed at a position opposite to the liquid droplet ejecting surface of the recording head; and a conveying unit which conveys the recording medium between the recording head and the maintenance device, the recording head having a printing width larger than a width of the recording medium, and the maintenance device comprising a liquid housing unit which houses the liquid droplet from the recording head, and a cleaning unit which cleans the liquid droplet ejecting surface of the recording head.

2. The recording apparatus as claimed in claim 1, wherein the maintenance device comprises a cap unit being capable of approaching to and leaving from the liquid droplet ejecting surface of the recording head and having a concave part which seals airtightly the liquid droplet ejecting surface upon being in contact thereto.

3. The recording apparatus as claimed in claim 2, wherein the liquid housing unit is the concave part of the cap unit.

4. The recording apparatus as claimed in claim 1, wherein the cleaning unit is capable of approaching to and leaving from the liquid droplet ejecting surface and has a contact part comprising an elastic body that is movable along the liquid droplet ejecting surface upon being in contact thereto.

5. The recording apparatus as claimed in claim 1, wherein the maintenance device comprises a recovering unit that recovers the liquid fed to the recording head.

6. The recording apparatus as claimed in claim 5, wherein the recovering unit is a negative pressure inducing device which recovers the liquid by applying a negative pressure to a concave part of the maintenance device.

7. The recording apparatus as claimed in claim 5, wherein the recovering unit is a liquid absorbent disposed in a concave part of the maintenance device.

8. The recording apparatus as claimed in claim 1, wherein the maintenance device comprises a plurality of cap units, being capable of approaching to and leaving from the liquid droplet ejecting surface of the recording head and having a concave part which seals airtightly the liquid droplet ejecting surface upon being in contact thereto, wherein the plurality of cap units are integrally driven.

9. The recording apparatus as claimed in claim 1, wherein the maintenance device comprises a plurality of cleaning units, wherein the cleaning units are integrally driven.

10. The recording apparatus as claimed in claim 2, wherein the cap unit and the cleaning unit are driven as being capable of moving relatively to each other.

11. The recording apparatus as claimed in claim 1, wherein the recording head is fixed.

12. The recording apparatus as claimed in claim 1, wherein the recording head is constituted with a plurality of unit recording heads.

13. The recording apparatus as claimed in claim 12, wherein the recording head is constituted by combining a plurality of recording head arrays, each of which is constituted with the plurality of unit recording heads arranged in a width direction.

14. The recording apparatus as claimed in claim 13, wherein the conveying unit for the recording medium is disposed among the plurality of recording head arrays or between the plurality of unit recording heads.

15. The recording apparatus as claimed in claim 13, wherein a liquid droplet is ejected to the liquid housing unit by each of the plurality of recording head arrays constituting the recording head.

16. The recording apparatus as claimed in claim 13, wherein the plurality of recording head arrays are arranged in the conveying direction of the recording medium, and the plurality of unit recording heads are arranged in a staggered form in plane view.

17. The recording apparatus as claimed in claim 12, wherein a liquid droplet is ejected to the liquid housing unit by each of the plurality of unit recording heads constituting the recording head.

18. The recording apparatus as claimed in claim 1, wherein the recording apparatus comprises a plurality of recording heads that are arranged in a conveying direction of the recording medium.

19. The recording apparatus as claimed in claim 18, wherein the cleaning unit is controlled as being capable of cleaning the recording heads disposed at different positions in the conveying direction.

20. The recording apparatus as claimed in claim 18, wherein the plurality of recording heads eject liquids having different colors.

21. The recording apparatus as claimed in claim 18, wherein a liquid droplet is ejected to the liquid housing unit by each of the plurality of recording heads.

22. The recording apparatus as claimed in claim 1, wherein a liquid droplet is ejected to the liquid housing unit from a nozzle of the recording head, the nozzle having ejected no liquid droplet during recording.

23. The recording apparatus as claimed in claim 1, further comprising:

a removing member that removes contamination attached to the cleaning unit by contacting with the cleaning unit, disposed on a moving path of the cleaning unit.

24. A recording apparatus comprising:

a recording head array comprising a plurality of unit recording heads ejecting liquid droplets and arranged in a width direction of a conveyed recording medium with a constant interval;

a cleaning unit that cleans a liquid droplet ejecting surface of the unit recording head; and a driving unit having a plurality of cleaning units that move integrally the cleaning units in an arranging direction of the plurality of unit recording heads or in a direction perpendicular to the arranging direction.

25. The recording apparatus as claimed in claim 24, wherein the driving unit comprises:

a first support having the plurality of cleaning units attached thereto; and a driving device that elevates the first support and moves the plurality of cleaning units in an arranging direction of the plurality of unit recording heads or in a direction perpendicular to the arranging direction.

26. The recording apparatus as claimed in claim 25, wherein the driving unit comprises a plurality of first supports, wherein driving directions of the plurality of first supports are opposite to each other in respective recording head arrays adjacent to each other.

27. The recording apparatus as claimed in claim 25, wherein disposing positions of a plurality of driving units for respective first supports adjacent each other are opposite to each other in respective recording head arrays adjacent to each other.

28. The recording apparatus as claimed in claim 25, wherein the cleaning unit rises from the first support, and upon moving the first support in the arranging direction of the plurality of unit recording heads or in a direction perpendicular to the arranging direction, the cleaning unit comprises a second gantry shape flame over a cap unit and a contact part attached to an upper surface of a beam of the second gantry shape flame.

29. The recording apparatus as claimed in claim 28, further comprising:

a second support comprising a plurality of cap units, and an elevating unit that elevates the second support, wherein the elevating unit elevates the second support to move the plurality of cap units among a capping position where the liquid droplet ejecting surface is capped, a recording position lower than the capping position where the recording medium is capable of being conveyed, and a cleaning position lower than the recording position where the second gantry shape flame is capable of moving thereover.

30. A recording apparatus comprising:

a recording head having a liquid droplet ejecting surface, the recording head ejecting a liquid droplet to a recording medium;

a maintenance device disposed at a position opposite to the liquid droplet ejecting surface of the recording head;

a conveying unit which conveys the recording medium between the recording head and the maintenance device, and a removing member that removes contamination attached to the cleaning unit by contacting with the cleaning unit, disposed on a moving path of the cleaning unit, the maintenance device comprising a liquid housing unit which houses the liquid droplet from the recording head, and a cleaning unit which cleans the liquid droplet ejecting surface of the recording head, and the removing member comprising a first gantry shape flame disposed over first support and a liquid droplet absorbent attached to a lower surface of a beam of the first gantry shape flame and being in slidably contact with the cleaning unit.

31. The recording apparatus as claimed in claim 30, wherein the liquid droplet absorbent is exchangeable.

32. The recording apparatus as claimed in claim 30, wherein the beam of the first gantry shape flame extends between a plurality of recording head arrays and is positioned between a plurality of unit recording heads to function as a guide part that guides the recording medium conveyed.

33. The recording apparatus as claimed in claim 30, wherein a driving device elevates and moves the first support comprising a plurality of cleaning units in the arranging direction of a plurality of unit recording heads to clean the liquid droplet ejecting surface with the plurality of cleaning units, and then brings down the first support to make the plurality of cleaning units in slidably contact with the liquid droplet absorbent of the first gantry shape flame, followed by being reverted to a home position.

* * * * *